US005170000A

United States Patent [19]

Hayashida et al.

[11] Patent Number: 5,170,000

[45] Date of Patent: Dec. 8, 1992

[54] SOUND BOARD ASSEMBLY FOR MUSICAL INSTRUMENTS

[75] Inventors: Hajime Hayashida; Toshiya Yamada; Kinya Nozaki; Akira Takemura, all of Hamamatsu, Japan

[73] Assignee: Yamaha Corporation, Hamamatsu, Japan

[21] Appl. No.: 539,221

[22] Filed: Jun. 15, 1990

[30] Foreign Application Priority Data

| | | | |
|---|---|---|---|
| Jun. 16, 1989 | [JP] | Japan | 1-153619 |
| Jun. 16, 1989 | [JP] | Japan | 1-153620 |
| Jun. 16, 1989 | [JP] | Japan | 1-153621 |
| Jun. 22, 1989 | [JP] | Japan | 1-159959 |
| Jun. 22, 1989 | [JP] | Japan | 1-159960 |
| Jun. 22, 1989 | [JP] | Japan | 1-159961 |
| Jun. 22, 1989 | [JP] | Japan | 1-159962 |
| Jun. 28, 1989 | [JP] | Japan | 1-165588 |
| Jun. 28, 1989 | [JP] | Japan | 1-165589 |
| Jun. 28, 1989 | [JP] | Japan | 1-165590 |
| Jul. 7, 1989 | [JP] | Japan | 1-176050 |

[51] Int. Cl.[5] ..... G10C 3/06

[52] U.S. Cl. ..... 84/192; 84/291; 84/402

[58] Field of Search ..... 84/184, 185, 187, 189, 84/192, 265, 275, 291, 402, 403, 410, 193–196

[56] References Cited

U.S. PATENT DOCUMENTS

| | | | |
|---|---|---|---|
| 578,154 | 3/1897 | Livingston | 84/192 |
| 1,727,637 | 9/1929 | Disler | 84/192 |
| 2,575,293 | 11/1951 | Petek | 84/275 |
| 4,348,933 | 9/1982 | Kaman et al. | 84/402 |
| 4,788,964 | 1/1988 | Sawada et al. | 84/402 |
| 4,805,513 | 2/1989 | Ito et al. | 84/193 |

*Primary Examiner*—Michael L. Gellner
*Assistant Examiner*—Eddie C. Lee
*Attorney, Agent, or Firm*—Spensley Horn Jubas & Lubitz

[57] ABSTRACT

In a sound board assembly for a musical instrument, a plurality of straight-grain wood veneers are joined together in a plane to form a plate unit having front and rear surfaces. Each of the wood veneers has two lateral sides which extend in a direction along the grain of the wood veneer. The lateral sides of the wood veneer serve respectively as a pair of abutments. One of the pair of abutments of one of each pair of adjacent wood veneers is abutted against and joined to one of the pair of abutments of the other wood veneer. A plurality of voids are formed inside of the plate unit. Substantially, the voids are formed along a neutral plane of the plate unit which is in the middle of the two surfaces. Thanks to the voids in the plate unit, the above sound board assembly is capable of sufficiently exhibiting the merit of a woody sound, capable of setting the sound quality artificially and freely, and capable of realizing the woody sound that has more warmth than in the case where high-quality natural woods are used.

30 Claims, 24 Drawing Sheets

SOUND BOARD ASSEMBLY FOR MUSICAL INSTRUMENTS

BACKGROUND OF THE INVENTION

The present invention relates to a sound board assembly for a musical instrument, which is suitable for use in, for example, a piano or the like.

As is well known, the piano is among the struck string musical instruments. A sound generating mechanism of the piano will be described with reference to FIG. 94 of the attached drawings. A hammer 1 is angularly moved in interlocking relation to the movement of a key or note to hit a string 2. The free oscillation or vibration of the string 2 excited by the hitting thereof drives a sound board assembly 3, which that is a sound radiator, through a string support section called a bridge 4. As a result, a sound is emitted from the sound board assembly 3. As will be understood from the above-described sound generating mechanism, the role of the sound board assembly 3 in the piano is extremely important. It is not too much to say that the characteristics of the sound of the piano are almost completely determined by the physical properties of the material of the sound board assembly 3.

There are two characteristics required of piano sound: a good response with respect to the hitting of the strings and a good elongation or spreading of the sound. Accordingly, it is necessary for the sound board assembly 3 to its characteristics which fulfill the above requirements. It has conventionally been considered that Picea woods such as spruce or the like are suitable as such material having the above-mentioned characteristic.

If the sound board assembly is made only from natural woods, the specific modulus of elasticity E/lo, where E is a Young's modulus and lo is density, is limited to values peculiar to the woods. Thus, there is a problem in that it is impossible to achieve sound generating efficiencies beyond a certain extent. In view of this, a sound board assembly has been developed as disclosed in, for example, Japanese Patent Unexamined Publication Nos. SHO 60-57894 and SHO 60-57895 in which the sound generating efficiency is raised to favorably generate sounds from low-pitched ranges to high-pitched ranges. In the sound board assembly, material consisting of cores in the sound board assembly of a laminate structure is selected, or sheets are interposed in the laminate structure, in order to increase the modulus of rigidity G and to reduce the internal friction loss $Q^{-1}$ or the shear loss tangent tan delta.

Further, a sound board assembly has also been developed as disclosed in Japanese Patent Unexamined Publication No. SHO 57-136693, in which, in order to produce clear musical qualities (tone colors), carbon fibers arranged in the direction of the grain of the surface-layer plates of the sound board assembly are applied respectively to both sides of an internal-layer plate of the sound board assembly, to increase the modulus of longitudinal elasticity E and to reduce the shear loss tangent tan delta. With this sound board assembly, the damping factor is reduced due to internal friction.

That the above-described conventional sound board assembly exhibits the merit of the woody sound peculiar to a natural musical instrument, that is, a warmth of sound which is not metallic; however, this is insufficient. Thus, there is a problem in that the conventional sound board assembly is inferior in its audibility characteristics.

SUMMARY OF THE INVENTION

It is therefore an object of the invention to provide a sound board assembly capable of sufficiently exhibiting the merit of a woody sound, capable of setting the sound quality artificially and freely, and capable of realizing the woody sound which has more warmth than in the case where high-quality natural woods are used.

It is another object of the invention to provide a sound board assembly in which it is possible to increase the mechanical strength and the positioning accuracy at the joining sections between each pair of adjacent wood veneers.

It is still another object of the invention to provide a sound board assembly in which, in view of the fact that a high-quality material is suitable for the sound board assembly, and particularly for a piano sound board assembly, an attempt can be made to improve the yield of sound board material which is high in cost.

It is another object of the invention to provide a sound board assembly in which it is possible to set artificially and freely the quality of sound in accordance with generating compasses in every part or sections.

It is another object of the invention to provide a sound board assembly in which it is possible to set the quality of sound artificially and freely, particularly in the string support section of the plate unit which is on the low-pitched sound side.

According to the invention, there is provided a sound board assembly for a musical instrument, comprising:

a plurality of straight-grain wood veneers (quarter sawn grain wood veneers) joined together in a plane to form a plate unit having front and rear sides, each of the wood veneers having two surfaces which ar both lateral sides extending in a direction along the grain of the wood veneer, the lateral sides of the wood veneer serving respectively as a pair of abutments, one of the pair of abutments of one of each pair of adjacent wood veneers being abutted against and joined to one of the pair of abutments of the other wood veneer; and a plurality of voids formed in the plate unit.

Substantially, the voids are formed along a neutral plane of the plate unit which is in the middle of the two surfaces, and no void around the two surface (surface layers) is preferable.

Preferably, the voids are formed by a plurality of grooves extending in the direction of the grain.

Preferably, each of the grooves is formed in at least one of the adjacent respective abutments of a corresponding pair of the wood veneers, which are abutted against each other.

With the above arrangement of the invention, a characteristic value of the sound board assembly, which corresponds to the modulus of rigidity G, is reduced, whereby the musical-quality associated property E/G, which is a ratio between the modulus of longitudinal elasticity E and the modulus of rigidity G increases. Accompanied with the increase in E/G, a characteristic is obtained such that the frequency characteristic of internal friction loss $Q^{-1}$ increases in the high-pitched range. As a result, an action like high-cut filtering occurs in the sound board assembly.

Thus, it is possible to sufficiently exhibit the merit of a woody sound, to set the sound quality artificially and freely, and to realize woody sound which has warmth in equal or greater measure than the case where high-quality natural woods are used.

Preferably, each of the voids is formed in at least one of the adjacent respective abutments of a corresponding pair of the wood veneers, which are abutted against each other. The voids extend in the direction of the grain. The voids have their respective widths in a direction perpendicular to the direction of the grain. The widths are different from each other.

With the above arrangement of the invention, that is, by suitably differentiating widths of the respective voids from each other, it is possible to set the value of E/G to a desired value, to adjust the balance between compasses (tone ranges), and to suitably set characteristics such as the quality of sound and so on.

Preferably, each of the voids is formed in at least one of the adjacent respective abutments of a corresponding pair of the wood veneers, which are abutted against each other. The voids extend in the direction of the grain and have their respective predetermined depths in a direction perpendicular to the direction of the grain. One of the respective abutments of each pair of adjacent wood veneers, which are abutted against each other, is formed with a projection, while the other abutment is formed with a recess in to which the projection is fitted.

With the above arrangement of the invention, since the projection and the recess of each pair of adjacent respective wood veneers are fitted in to each other at the corresponding one of a plurality of joining sections between the wood veneers, the mechanical strength of the sound board assembly increases. Further, since the positioning of the wood veneers is done by the fitting, the positioning accuracy will necessarily be raised.

Preferably, the wood veneers have respective grains which are arranged in parallel relation to each other. The wood veneers have respective pairs of cross-grain surfaces which serve respectively as the pairs of abutments of the respective wood veneers. Each of the wood veneers is composed of a pair of laminate elements which are superimposed upon each other with a predetermined gap left between them. The predetermined gap forms the corresponding one of the voids. The sound board assembly further includes a plurality of intermediate connecting elements, each of which has a pair of abutments and a pair of fittings. The pair of laminate elements of one of each pair of adjacent wood veneers are abutted respectively against the pair of laminate elements of the other wood veneer respectively through the pair of abutments of the intermediate connecting element, and the pair of fittings of the intermediate connecting element are fitted respectively in the predetermined gaps respectively between the pair of laminate elements of one of each pair of adjacent wood veneers and between the pair of laminate elements of the other wood veneer. The wood veneers are connected to and fixedly mounted to each other respectively through the intermediate connecting elements.

With the above arrangement of the invention, that is, since each of the straight-grain wood veneers which together form the sound board assembly is divided into small units, even if there is a deficient or defective portion or portions in the material, it is possible to cut the material into the wood veneers efficiently from the remaining portion of the material. Thus, an attempt can be made to improve the yield of the material.

Preferably, each of the voids is formed in at least one of the adjacent respective abutments of a corresponding pair of the wood veneers, which are abutted against each other. The voids extend in the direction of the grain. The voids have their respective widths in a direction perpendicular to the direction of the grain. Each of the widths varies in the direction of the grain.

Preferably, each of the voids is gradually enlarged in width from one end of the void to the other end thereof.

With the above arrangement of the invention, since the width of each of the voids suitably varies in the direction of the grain, it is possible to set the value of E/G to a desired value, to adjust the balance between compasses, and so on. Further, it is possible to set the characteristics of the quality of sound.

Preferably, each of the voids is formed in at least one of the adjacent respective abutments of a corresponding pair of the wood veneers, which are abutted against each other. The voids extend in the direction of the grain. The plate unit has a first region of low-pitched sound (low frequency sound) and a second region of high-pitched sound (high frequency sound). The voids are arranged only at a location adjacent to the first region.

With the above arrangement of the invention, since the voids are arranged only at the location adjacent to the first region, the effects of the improvement in the quality of sound are considerably exhibited chiefly on the side of the low-pitched range, so that it is possible to optimize the balance in the quality of sound between compasses.

Preferably, the wood veneers have respective grains which are arranged in parallel relation to each other. The wood veneers have respective pairs of cross-grain surfaces (flat sawn grain surfaces) which serve respectively as the pairs of abutments of the respective wood veneers. Each of the wood veneers is composed of a pair of laminate elements whose respective straight-grain surfaces are superimposed upon each other. One of the pair of laminate elements of each of the wood veneers has a straight-grain surface which is formed therein with at least one groove extending in the direction of the grain. The groove forms the corresponding void. The straight-grain surface of one of the pair of laminate elements of each of the wood veneer in which the groove is formed serves as an abutment surface, which is bonded to the straight-grain surface of the other laminate element.

With the above arrangement of the invention, since thickness is not so necessary for each of the laminate elements, each pair of which form the corresponding wood veneer, it is possible to use thin laminate elements. That is, even if thin laminate elements are used, a quality can be realized which is a match for that of laminate elements superior in quality. Further, since thin laminate elements cut from raw material can be used, it is possible to raise the yield.

Preferably, the voids are formed by a plurality of bores which are formed in at least one of the pairs of abutments of the respective wood veneers. The bores extend in a direction substantially perpendicular to the direction of the grain.

With the above arrangement of the invention, since the internal friction loss $Q^{-1}$ in the high-frequency range is large when driving of the sound board assembly, noises with a high-frequency component, which tend to be emitted as a sound, are reduced so that the musical quality can be improved. Further, the musical quality can be improved by an extremely simple woodworking technique: the bores are formed before the straight-grain wood veneers are joined together. Moreover, the Young's modulus and other acoustic properties which depend upon the density, which are required in the sound board assembly, are hardly adversely affected.

Preferably, the voids are formed by a plurality of bores which are formed in at least one of the pairs of abutments of the respective wood veneers. The bores extend in a direction substantially perpendicular to the direction of the grain and have their respective diameters and depths. The bores formed in at least one of the pair of abutments of each of the wood veneers are arranged at their respective pitches. At least one of the pitches, the diameters and depths of the bores formed in at least one of the pair of abutments of each of the wood veneers varies in the direction of the grain.

With the above arrangement of the invention, at least one of a plurality of factors, including the pitches, the diameters and depths of the respective bores varies along the direction of the grain. Accordingly, at least one of these factors suitably varies in accordance with the string support section of the sound board assembly from the side of the low-pitched sound to the side of the high-pitched sound, whereby it is possible to set the balance in the quality of sound between the compasses to an optimum state.

Specifically, it is possible to suitably alter at least one factor in accordance with the generating compasses of the sound board assembly, whereby the values of the musical-quality associated property E/G in various parts or sections of the sound board assembly are freely altered, so that it is possible to obtain the optimum quality of sound which is required for the various generating compasses.

Preferably, the voids are formed by a plurality of bores which are formed in at least one of the pairs of abutments of the respective wood veneers. The bores extend in a direction substantially perpendicular to the direction of the grain. The plate unit has a first region of low-pitched sound and a second region of high-pitched sound. The bores are arranged only at a location adjacent to the first region.

With the above arrangement of the invention, since the bores are arranged only at the specific section of the sound board assembly, that is, at the string supporting section on the side of the low-pitched sound to which the oscillation of the strings on the side of the low-pitched sound is transmitted through a bridge, the quality of sound in the low-pitched range is particularly improved, so that it is possible to set the balance in the quality of sound to an optimum state.

Specifically, since the bores are formed at the generating section of the low-pitched sound of the sound board assembly and extend substantially perpendicular to the grains of the respective wood veneers, the strength of the wood veneers at the generating section with respect to the shear deformation of the sound board assembly, that is, the characteristic equivalent to the modulus of rigidity G is reduced. Thus, it is possible to raise the value of the musical-quality associated property E/G, particularly in the string support section of the sound board assembly on the side of the low-pitched sound, to a value which is impossible with natural woods. In this manner, it is possible to realize a woody sound which has more warmth than the conventional natural woods.

Preferably, the voids are formed by a plurality of bores which are formed in at least one of the pairs of abutments of the respective wood veneers. The bores extend in a direction substantially perpendicular to the direction of the grain and have their respective diameters and depths. The bores, which are formed in at least one of the pair of abutments of each of the wood veneers, are arranged at their respective pitches. At least one of the pitches, the diameters and depths of the bores formed in at least one of the pair of abutments of one of each pair of adjacent wood veneers is different from that of the pitches, the diameters and depths of the bores formed in at least one of the pair of abutments of the other wood veneer.

With the above arrangement of the invention, at least one of a plurality of factors, including the pitches, the diameters and depths of the respective bores is different from wood veneer to wood veneer. Accordingly, at least one factor suitably varies from the central region of the plate unit to a peripheral region thereof, whereby the characteristic of the sound board assembly equivalent to the modulus of rigidity G is reduced at a predetermined ratio, so that it is possible to vary the value of the musical-quality associated property in the various sections. Thus, it is possible to set the balance in the quality of sound between the compasses to an optimum state.

As a result, it is possible to obtain individuality of the balance in the quality of sound.

DESCRIPTION OF THE EMBODIMENTS

Figure 1:
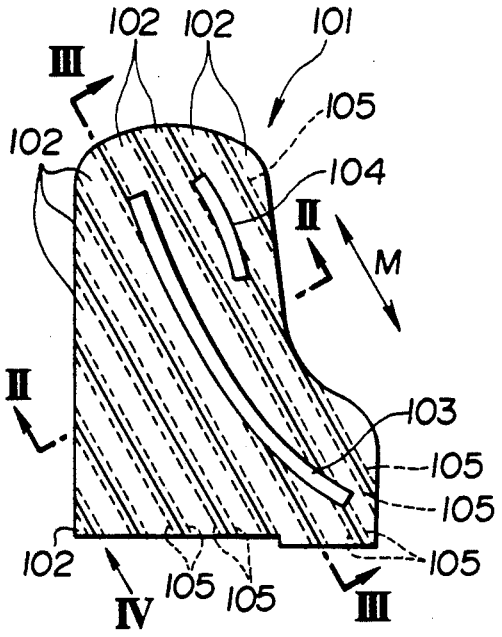
FIG. 1 is a top plan view of a sound board assembly according to a first embodiment of the invention.

Various embodiments of the invention will be described below with reference to the drawings. It should be noted that like or similar components and parts are designated by the same or like reference numerals throughout the drawings, and the description of the like or similar components and parts will be simplified or omitted to avoid repetition.

Fundamental or Basic Principle

The fundamental or basic principle of the invention will first be described.

First, as described previously, important in the vibration or oscillation characteristics of the sound board assembly in a piano on a time axis are: a good or excellent response with respect to string oscillation, and adequate conservation of energy, that is, adequate non-damping. The reason for this is that the former characteristic corresponds to the excellent rise of a sound, while the latter characteristic corresponds to the elongation or spreading of the sound. Known as physical quantities for appraising the sound board material from these two viewpoints are the specific dynamic Young's modulus E/lo, where E is the dynamic Young's modulus and lo is the density and the internal friction loss tangent or shear loss tangent tan delta. Spruce of Picea or the like, which is excellent as the sound board material, has a large E/lo and a small tan delta.

Next, in order to consider the quality of sound of the piano, it is necessary to consider the frequency characteristics of the sound board material.

The frequency characteristics are investigated or examined as follows. A plate-like sample having a constant configuration is oscillated under conditions in which both ends are free and each resonance frequency of deflection oscillation excited, and the damping characteristics thereat are measured. From the measurement results and the solution of an oscillation equation of the Euler-Bernoulli beam which takes only the elasticity of the plate into consideration, an apparent Young's modulus E'freq and an internal friction loss $Q^{-1}$ at each resonance point are successively obtained. In this manner, the apparent frequency characteristics of each sound board material are investigated. When the frequency characteristics thus obtained are compared with the musical quality tendencies of the sound board material in terms of audibility, it has been found that there is a constant correlation between the frequency characteristics and the musical quality tendencies. This is considered as follows. Specifically, the apparent frequency characteristics of the Young's modulus determine the cyclic strain within the sound board assembly when excited by the string oscillation, that is, the frequency characteristics of the displacement amplitude and, as a result, the frequency characteristics of the energy loss due to the internal friction are determined.

The Young's modulus is originally a physical property peculiar to the material, and has no frequency dependency. According to the above-described measurement results and the analysis thereof, however, the apparent Young's modulus has a predetermined frequency characteristic. This can be explained by the Ghoense's solution obtained under the boundary condition that both ends are free, with respect to the oscillation equation of a so-called Chemoshenko's beam, in which a shear force and a rotational inertia force generated in the plate are also taken into consideration. It is proved that, in the Ghoense's solution, the apparent Young's modulus E'freq at each resonance point has a frequency characteristic by taking the shear force within the system into consideration. For instance, in the case of a rectangular bar or rod having an equal cross-section, the apparent Young's modulus can be expressed as follows:

$$E'\text{freq} = \frac{48pai^2 lo^4 f^2}{m^4 h^2} \cdot \left\{ 1 + \frac{1}{12}\left(\frac{h}{1}\right)^2 2mF(m)\left(3 - \frac{sE}{G}\right) + \frac{1}{12}\left(\frac{h}{1}\right)^2 m^2 F^2(m)\left(1 + \frac{sE}{G}\right) - \frac{1}{12}\left(\frac{h}{1}\right)^2 \frac{\frac{1}{12}\left(\frac{h}{1}\right)^2 m^4 \frac{sE}{G}}{1 + \frac{1}{12}\left(\frac{h}{1}\right)^2 m^2\left(1 + \frac{sE}{G}\right)} \right\} \quad (1)$$

where f is the eigenfrequency (frequency of characteristic vibration) of the bar;

l is a length of the bar;

h is the thickness;

m and F(m) are an oscillation degree and a constant determined by the boundary condition, respectively; and s is a constant determined by the cross-sectional configuration.

As will be understood from the above equation (1), the frequency characteristic of the apparent Young's modulus E'freq varies depending upon E/G, which is a ratio between the modulus of longitudinal elasticity and the modulus of rigidity. In other words, the value of E/G determines the frequency characteristics of the internal friction loss $Q^{-1}$, which determines the filter characteristics of the sound board assembly and which determines the musical quality.

The spruce material or the like, which is known as a material generating a woody sound having warmth, indicates a considerably high value of the ratio E/G between the modulus of longitudinal elasticity and the modulus of rigidity, as compared with other industrial materials. Further, it is apparent from previous research that a material generally called high-quality material has a considerably high E/G value. In this connection, reference should be made, for example, to the Paper "Engineering on the Quality of Sound in Pianos", the Japan Machinery Institute Journal, Vol. 91, No. 836. It has been thought that when E/G increases to a large value, the high-quality material has characteristics like those in one in which a loss in the high-frequency range increases, in other words, in one like a high-cut filter, creating a primary factor which generates a woody sound or a musical quality having warmth.

Further, it has been found that the value of E/G has a strong correlation relationship with respect to the following characteristics of the piano sound.

(I) The musical-quality associated material property has a positive correlation with respect to the how-to-sound characteristics of a sound, that is, with respect to the nature and heavy pressure of a sound;

(II) The musical-quality associated material property has a positive correlation with respect to the characteristics of the depth of a sound, that is, with respect to the depth and many low frequency components; and (III) The musical-quality associated material property has a negative correlation with respect to noise emission characteristics or sound emission characteristics, that is, with respect to the ratio of the high frequency or noises contained in the emission sound, or much noise contained in E/G and the emission sound.

These relationships are depicted in the following table.

TABLE 1

| SMALL | - [E/G] - | LARGE |
|---|---|---|
| METALLIC SOUND | | WOODY SOUND |
| SHALLOW IN SOUND | | DEEP IN SOUND |
| MUCH NOISE | | LESS NOISE |

As will be clear from the foregoing, if the value of the musical-quality associated material property of the entire wood plate assembly increases and a high loss in the high-frequency range, that is, the high-cut filter-like characteristics are emphasized, a woody sound superior to or as good as that of a natural musical instrument can efficiently be exhibited as a whole, so that a woody sound having further warmth can be realized.

On the other hand, in the aforementioned Japanese Patent Unexamined Publication Nos. SHO 60-57894 and SHO 60-57895, it is impossible to obtain a woody sound, because the modulus of rigidity G increases so that the value of E/G decreases or is reduced. Further, in the aforesaid Japanese Patent Unexamined Publication No. 57-136693, it is impossible to obtain a woody sound having warmth, because the internal friction loss $Q^{-1}$ in the high zone or region is reduced, so that the high-frequency component is acoustically radiated and becomes a noise component.

Arrangement and Function of Embodiments

Figure 2:
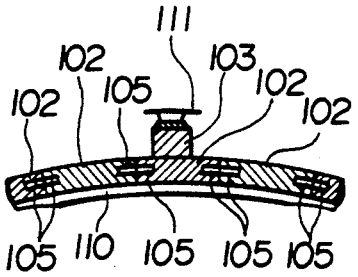
FIG. 2 is a fragmentary cross-sectional view taken along the line II—II in FIG. 1.
Figure 3:
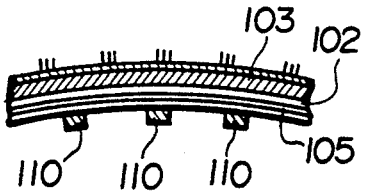
FIG. 3 is a fragmentary cross-sectional view taken along the line III—III in FIG. 1.

Referring now to FIGS. 1 through 3, there is shown a sound board assembly according to the first embodiment of the invention. As shown in FIG. 1, the sound board assembly comprises a plurality of straight-grain wood veneers 102 which are joined together in a plane to form a plate unit 101 having front and rear sides. The sound board assembly in the first embodiment is intended to be used for a grand piano. Each of the wood veneers 102 has two sides which extend in a direction M along the grain of the wood veneer 102. The sides of the wood veneer 102 serve respectively as a pair of abutments. One of the pair of abutments of one of each pair of adjacent wood veneers 102 is abutted against and joined to one of the pair of abutments of the other wood veneer 102.

At least one long bridge 103 is provided at the central part of the plate unit 101 on the front side thereof and extends substantially in the direction M of the grain. Further, at least one short bridge 104 is provided at the upper right-hand portion of the plate unit 101 on the front side thereof and extends substantially in the direction M of the grain. The long bridge 103 is longer than the short bridge 104. As shown in FIG. 2, a plurality of strings 111 are supported by the long and short bridges 103 and 104 such that a musical interval is gradually raised from one end of the long bridge 103 to the other end thereof.

As indicated by the broken lines in FIG. 1, a plurality of grooves 105 are formed in the wood veneers 102 which extend in the direction M of the grain. Specifically, as shown in FIGS. 2 and 3, each of the grooves 105 is formed in the corresponding adjacent respective abutment of a corresponding pair of wood veneers 102, which are abutted against each other. The abutment of the wood veneers 102 extend in parallel relation to each other. The pair of abutments of each of the wood veneers 102 extend substantially in perpendicular relation to the front and rear sides of the plate unit 101. The groove 105 has a predetermined depth from the abutment of the wood veneer 102. Each pair of adjacent grooves 105 and 105 are aligned with each other in a direction perpendicular to the direction M of the grain. That is, each pair of adjacent facing grooves 105 and 105 together form the corresponding one of a plurality of voids formed in the plate unit 101.

As shown in FIGS. 2 and 3, a plurality of ribs 110 are provided on the rear side of the plate unit 101 and extend in spaced relation to each other in a direction perpendicular to the direction M of the grain. The ribs 110 compensate for the propagation of oscillation in the direction perpendicular to the direction M of the grain, and reinforce the entire plate unit 101.

Figure 4:
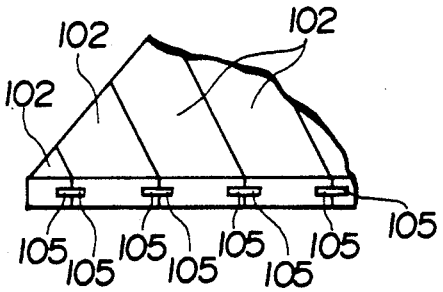
FIG. 4 is a fragmentary enlarged perspective view as viewed from the arrow IV in FIG. 1.
Figure 5:
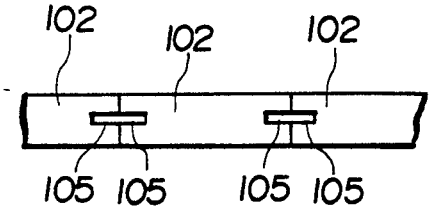
FIG. 5 is a fragmentary enlarged view showing the joining section between each pair of adjacent wood veneers illustrated in FIGS. 1 through 4.

Further, each of the grooves 105 is formed substantially at the center of a corresponding abutment of the wood veneer 102 and extends in the direction M of the grain. Here, FIGS. 4 and 5 are respectively a perspective view, in this case viewed from the arrow IV in FIG. 1 and an enlarged view of the joining surfaces among the wood veneers 102.

Figure 6:
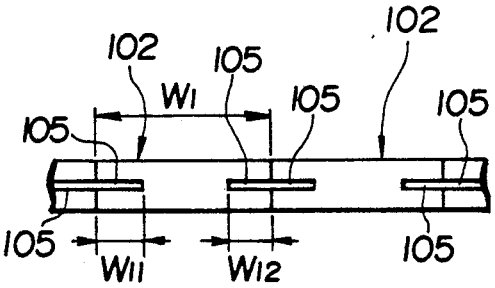
FIG. 6 is a fragmentary side elevational view showing the relationship between the width of each of the wood veneers and the depths of the grooves formed in both lateral sides of the wood veneer illustrated in FIGS. 1 through 5.

As described above, if the grooves 105 are provided respectively in both the abutments of each of the wood veneers 102,/the strength with respect to the shear deformation is reduced in the area of each of the grooves 105. Accordingly, it is possible to reduce the characteristic corresponding to the modulus of rigidity G with reference to the entire plate unit 101. Now, let it be supposed, as shown in FIG. 6, that the wood veneer 102 has a width $W_1$ and the grooves 105 and 105 of the wood veneer 102 have respective depths $W_{11}$ and $W_{12}$. Then, the value of the characteristic corresponding to the modulus of rigidity G can be varied or changed to a value which is almost $\{W_1-(W_{11}+W_{12})\}/W_1$ times. In this manner, it is possible to freely control the characteristic value which corresponds to the modulus of rigidity G. If the value corresponding to the modulus of rigidity G is reduced, the value of E/G increases, and if the value of E/G increases, the characteristic indicated by the previous table 1 is obtained. In this case, regarding to what or how degree or how E/G can increase, it is possible to optionally set E/G, depending upon the manner of setting the depth, width and so on of each of the grooves 105.

Figure 7:
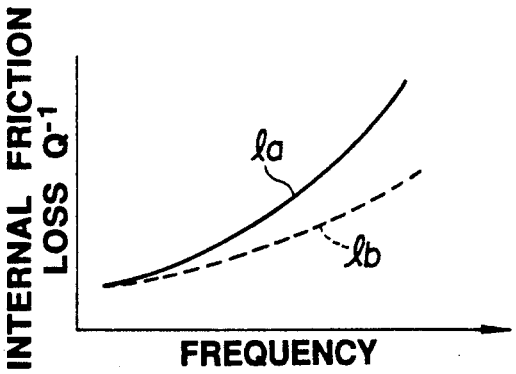
FIG. 7 is a characteristic view showing the frequency characteristic of the internal friction loss in the first embodiment illustrated in FIG. 1 through 5.

In the manner described above, the value of the musical-quality associated material property E/G increases whereby the frequency characteristic of the internal friction loss $Q^{-1}$ is brought to that indicated by the solid line $1_a$ in FIG. 7. That is, as compared with the conventional sound board material, i.e., a natural material such as the spruce material or the like indicated by the broken line $1_b$ in FIG. 7, the internal friction loss $Q^{-1}$ increases, particularly in the high-frequency zone or region. In this manner, by the increase in the internal friction loss $Q^{-1}$ in the high-frequency zone, noises of the high-frequency component which tend to be emitted as sounds are reduced, so that the musical quality is improved. Moreover, other acoustic properties or natures, which depend upon the Young's modulus and the density, such as the specific dynamic Young's modulus E/lo or the acoustic radiation efficiency $E/lo^3$ where lo is a density, required as the sound board assembly for a piano, are hardly adversely affected. Accordingly, a characteristic is obtained which is equal to or above that of the high-quality natural material which is generally used in the sound board assembly of the piano. Thus, it is possible to obtain a "sound", "warmth" and so on which are peculiar to woody sounds as a whole.

Figure 8:
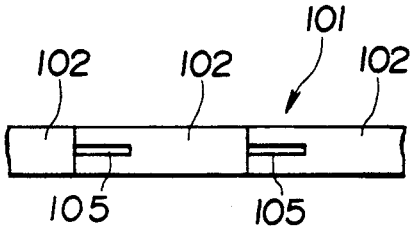
FIG. 8 is a view similar to FIG. 5, but showing a first modification of the first embodiment illustrated in FIGS. 1 through 5.

FIG. 8 shows a first modification of the first embodiment illustrated in FIGS. 1 through 3. In the first embodiment, the grooves 105 have been formed respectively in both the abutments of each of the wood veneers 102. As shown in FIG. 8, however, the arrangement may be such that the pair of abutments of each of the wood veneers 102 extend substantially in perpendicular relation to the front and rear sides of the plate unit 101, and that each of the grooves 105 is formed in only one of the adjacent respective abutments of a corresponding pair of wood veneers 102, which are abutted against each other. In this case, there is obtained such a functional advantage that the construction is made simple.

Figure 9:
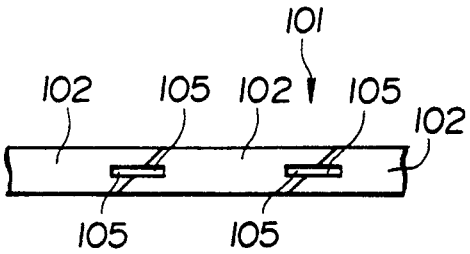
FIG. 9 is a view similar to FIG. 5, but showing a second modification of the first embodiment illustrated in FIGS. 1 through 5.

FIG. 9 shows a second modification of the first embodiment illustrated in FIGS. 1 through 3. In the second modification, the pair of abutments of each of the wood veneers 102 are inclined with respect to the front and rear sides of the plate unit 101, and each of the grooves 105 is formed in the corresponding adjacent respective abutment of the corresponding pair of wood veneers 102, which are abutted against each other. In this case, since in each pair of adjacent wood veneers 102 and 102, the respective areas by which they are bonded to each other increase, a functional advantage is obtained in that the bonding strength is improved.

Figure 10:
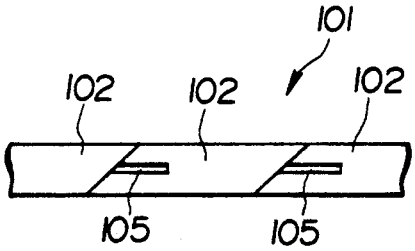
FIG. 10 is a view similar to FIG. 5, but showing a third modification of the first embodiment illustrated in FIGS. 1 through 5.

FIG. 10 shows a third modification of the first embodiment illustrated in FIGS. 1 through 3. As shown in FIG. 10, the arrangement may be such that the pair of abutments of each of the wood veneers 102 are inclined with respect to the front and rear sides of the plate unit 101, and that each of the grooves 105 is formed in only one of the adjacent respective abutments of the corresponding pair of wood veneers 102, which are abutted against each other.

Figure 11:
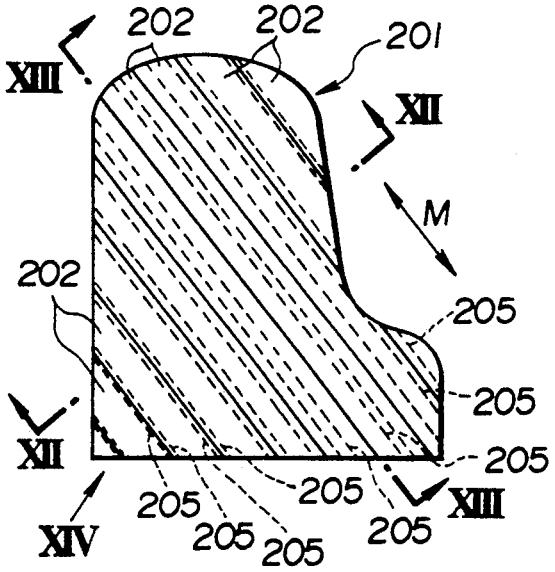
FIG. 11 is a top plan view of a sound board assembly according to a second embodiment of the invention.
Figure 12:
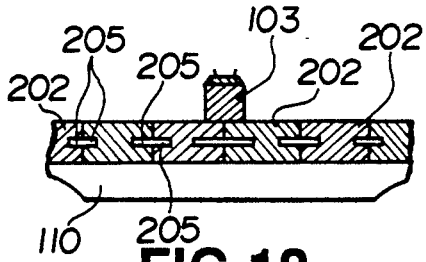
FIG. 12 is a fragmentary cross-sectional view taken along the line XII—XII in FIG. 11.
Figure 13:
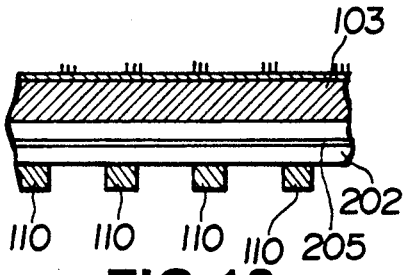
FIG. 13 is a fragmentary cross-sectional view taken along the line XIII—XIII in FIG. 11.

Referring next to FIGS. 11 through 13, there is shown a sound board assembly according to the second embodiment of the invention. As shown in FIG. 11, the sound board assembly comprises a plurality of straight-grain wood veneers 202 which are joined together in a plane to form a plate unit 201 having front and rear sides.

A plurality of grooves 205 are provided, each of which is formed in the corresponding adjacent respective abutment of the corresponding pair of a plurality of wood veneers 202. The grooves 205 extend in the direction M of the grain. The grooves 205 have their respective widths in a direction perpendicular to the direction M of the grain, which widths are different from each other, as shown in FIG. 12.

Figure 14:
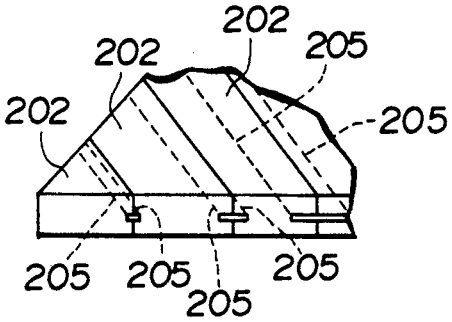
FIG. 14 is a fragmentary enlarged perspective view as viewed from the arrow XIV in FIG. 11.
Figure 15:
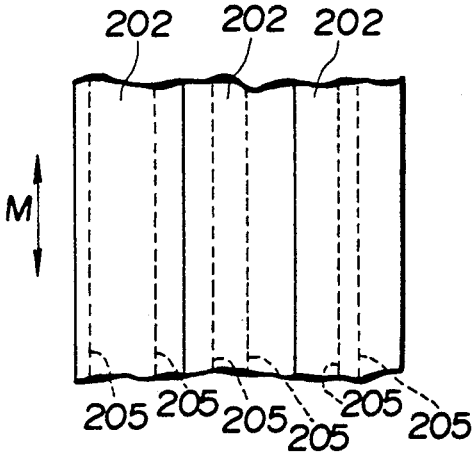
FIG. 15 is a fragmentary enlarged top plan view showing a plurality of wood veneers joined together, illustrated in FIGS. 11 through 14.

That is, as shown in FIG. 13, each of the grooves 205 is formed at a center of the corresponding pair of abutments of the corresponding wood veneer 202. The plate unit 201 has a central region and both end regions, and the grooves 205 have a maximum width at the central region of the plate unit 201 and are reduced in width gradually toward the end regions of the plate unit 201. As will be clear from FIGS. 14 and 15, the grooves 205 and 205 formed respectively in both the abutments of each of the wood veneers 202 are different in width from each other. Further, as shown in FIG. 12, each pair of adjacent grooves 205 together form a corresponding one of a plurality of voids formed in the plate unit 201.

Figure 16:
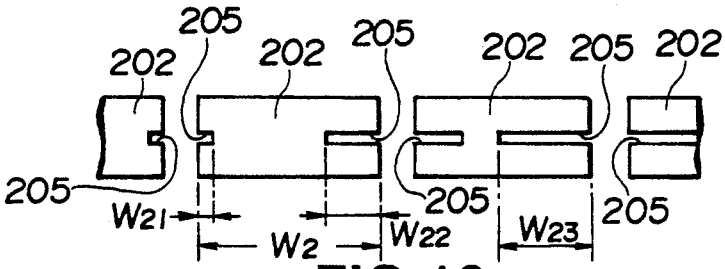
FIG. 16 is a fragmentary side elevational view showing the relationship between the width of each of the wood veneers and the depths of the respective grooves formed in both lateral sides of the wood veneer illustrated in FIGS. 11 through 15.

As shown in FIG. 16, it is assumed that the left- and right-hand grooves 205 and 205 of each of the wood veneers 202 have respective widths $W_{21}$ and $W_{22}$. Then, it is possible to increase the characteristic of the plate material equivalent to the modulus of rigidity by $\{W_2-(W_{21}+W_{22})\}/W_2$ times. Further, the widths of the right-hand grooves 205 and 205 of the above specific wood veneer 202 and the adjacent wood veneer 202 are set to $W_{22}$ and $W_{23}$ respectively. The relationship $W_{21}<W_{22}<W_{23}$ is obtained toward the central region of the plate unit 201. Conversely, the arrangement may be so set as to have the relationship $W_{21}>W_{22}>W_{23}$.

As described above, by suitably differentiating the widths of the respective grooves 205 from each other, it is possible to set the optimum musical quality required for each compass.

In connection with the above, it is most effective if the grooves 205 are located at the neutral axis of the sound board assembly.

In the second embodiment illustrated in FIGS. 11 through 13, the widths of the respective grooves 205 gradually increase toward the central region of the plate unit 201. Conversely, however, the arrangement may be such that the grooves 205 in the central region of the plate unit 201 have a reduced width and are enlarged in width gradually toward the opposite ends of the plate unit 201. One of these arrangements should be selected in accordance with the desired characteristics of the piano sound.

In place of the arrangement in which the widths of the respective grooves 205 are successively enlarged or reduced, the widths of the respective grooves 205 only in a specific portion or location may be enlarged or reduced. Alternatively, the widths of the respective grooves 205 may be set in accordance with an optional regularity.

Figure 17:
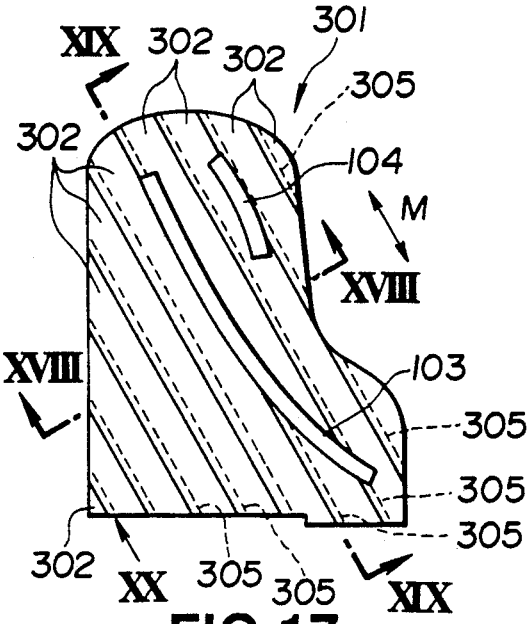
FIG. 17 is a top plan view of a sound board assembly according to the third embodiment of the invention.
Figure 18:
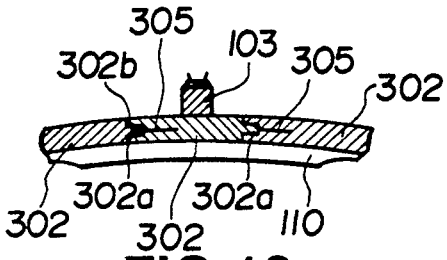
FIG. 18 is a fragmentary cross-sectional view taken along the line XVIII—XVIII in FIG. 17.
Figure 19:
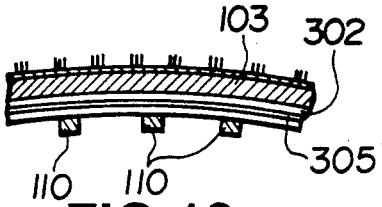
FIG. 19 is a fragmentary cross-sectional view taken along the line XIX—XIX in FIG. 17.

Referring next to FIGS. 17 through 19, there is shown a sound board assembly according to the third embodiment of the invention. As shown in FIG. 17, the sound board assembly comprises a plurality of straight-grain wood veneers 302 which are joined together in a plane to form a plate unit 301 having front and rear sides.

A plurality of grooves 305 are provided each of which is formed in only one of the adjacent respective abutments of a corresponding pair of wood veneers 302, which are abutted against each other. The grooves 305 extend in the direction M of the grain.

As shown in FIG. 18, one of the respective abutments of each pair of adjacent wood veneers 302, which are abutted against each other, is formed with a projection **302*a*, while the other abutment is formed with a recess 302*b*. The projection 302*a* of each of the wood veneers 302 is fitted respectively in the recess 302*b* in the adjacent wood veneer 302 so that the wood veneers 302 are joined to each other. Each of the projections 302*a* and the recesses 302*b* formed respectively on and in the adjacent respective abutments of a corresponding pair of wood veneers 302** has a rectangular cross-sectional configuration.

Figure 20:
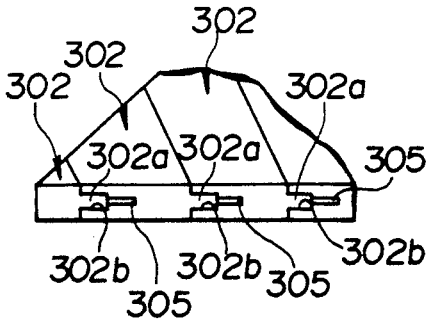
FIG. 20 is a fragmentary enlarged perspective view as viewed from the arrow XX in FIG. 17.
Figure 21:
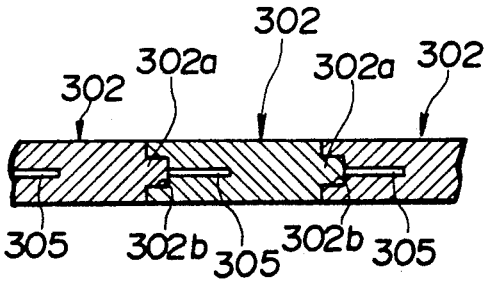
FIG. 21 is a fragmentary enlarged cross-sectional view showing the joining section between each pair of adjacent wood veneers illustrated in FIGS. 17 through 20.

As shown in FIGS. 20 and 21, each of the grooves 305 has a predetermined depth from the bottom of the recess **302*b* formed in one of the pair of abutments of a corresponding one of the wood veneers 302**, and extends along the direction M of the grain.

As described previously, since the projections **302*a* and the recesses 302*b*** are fitted respectively in to each other, the strength at each of the joined sections increases, and the positioning accuracy is improved.

Figure 22:
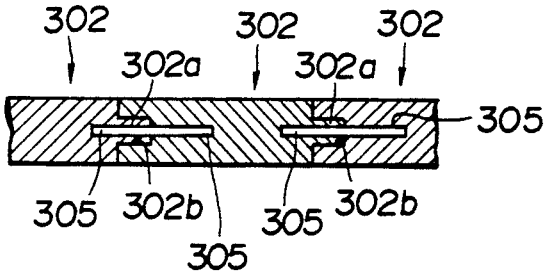
FIG. 22 is a view similar to FIG. 21, but showing a first modification of the third embodiment illustrated in FIGS. 17 through 21.
Figure 23:
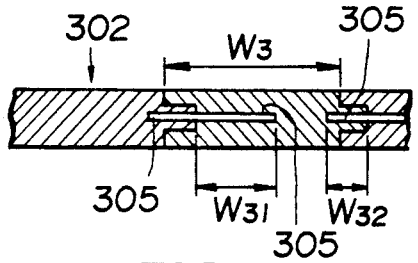
FIG. 23 is a fragmentary cross-sectional side elevational view showing the relationship between the width of each of the wood veneers and the depths of the respective grooves formed in both lateral sides of the wood veneer illustrated in FIG. 22.

In the above third embodiment, the grooves 305 are provided, each of which is formed in only one of the adjacent respective abutments of a corresponding pair of wood veneers 302, which are abutted against each other. As shown in FIG. 22, however, each of the grooves 305 may be formed in a corresponding adjacent respective abutment of a corresponding pair of the wood veneers 302, which are abutted against each other. In this case, as shown in FIG. 23, if it is assumed that each of the wood veneers 302 has a width $W_3$ and the grooves 305 and 305 have their respective widths $W_{31}$ and $W_{32}$, it is possible to vary the characteristic corresponding to the modulus of rigidity G almost $\{W_3-(W_{31}+W_{32})\}/W_3$ times. In this manner, it is possible to freely control the characteristic value corresponding to the modulus of rigidity G.

Figure 24:
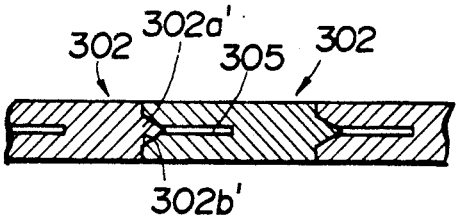
FIG. 24 is a view similar to FIG. 21, but showing a second modification of the third embodiment illustrated in FIGS. 17 through 21.

Further, as shown in FIG. 24, the arrangement may be such that each of the projections **302*a*' and the recesses 302*b*' formed respectively on and in the adjacent respective abutments of a corresponding pair of the wood veneers 302 has a triangular cross-sectional configuration. Moreover, the configuration of each of the projections 302*a* and the recesses 302*b* should not be limited to those described above. Each of the projections 302*a* and the recesses 302*b*** may be formed into other optical configurations.

Figure 25:
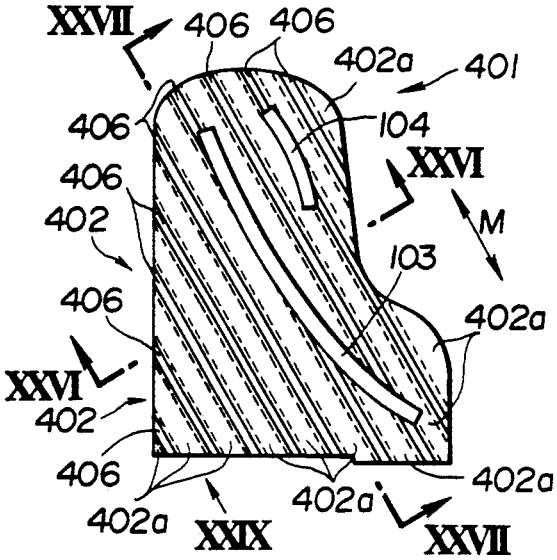
FIG. 25 is a top plan view of a sound board assembly according to the fourth embodiment of the invention.
Figure 26:
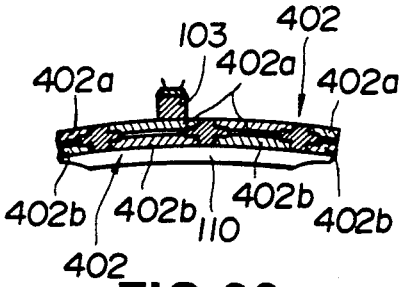
FIG. 26 is a fragmentary cross-sectional view taken along the line XXVI—XXVI in FIG. 25.
Figure 27:
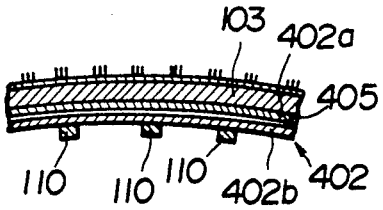
FIG. 27 is a fragmentary cross-sectional view taken along the line XXVII—XXVII in FIG. 25.

Referring next to FIGS. 25 through 27, there is shown a sound board assembly according to the fourth embodiment of the invention. As shown in FIG. 25, the sound board assembly comprises a plurality of straight-grain wood veneers 402 which are joined together in a plane to form a plate unit 401 having front and rear sides.

As shown in FIGS. 26 through 29, each of the wood veneers 402 is composed of a pair of laminate elements 402*a* and 402*b* which are superimposed upon each other with a predetermined gap 405 left therebetween. As clearly seen from FIG. 27, the gap 405 extends in the direction M of the grain. A plurality of intermediate connecting elements 406 are provided, each of which has a pair of abutments and a pair of fittings 406*a* and 406*b*. The pair of laminate elements 402*a* and 402*b* of one of each pair of adjacent wood veneers 402 are abutted respectively against the pair of laminate elements 402*a* and 402*b* of the other wood veneer 402 respectively through the pair of abutments of the intermediate connecting element 406. The pair of fittings 406*a* and 406*b* of the intermediate connecting element 406 are fitted respectively in the predetermined gaps 405 respectively between the pair of laminate elements 402*a* and 402*b* of one of each pair of adjacent wood veneers 402 and between the pair of laminate elements 402*a* and 402*b* of the other wood veneer 402. The wood veneers 402 are connected to and fixedly mounted to each other respectively through the intermediate connecting elements 406.

Figure 28A:
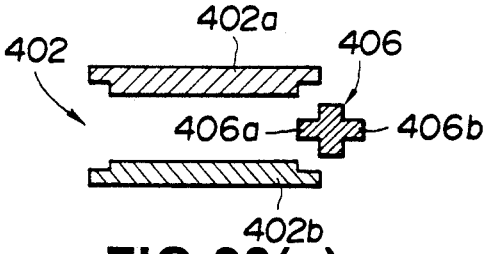
FIG. 28*a* is an enlarged exploded cross-sectional view for the explanation of an assembling state of one of a plurality of wood veneers and an intermediate connecting element associated therewith.
Figure 28B:
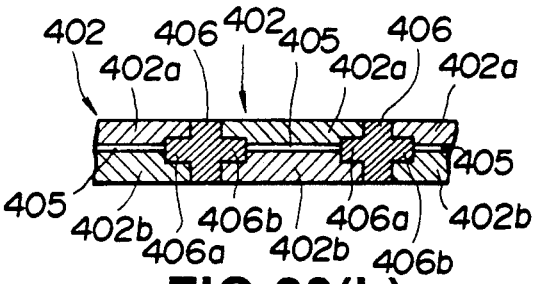
FIG. 28*b* is an enlarged cross-sectional view showing the assembled state of the wood veneers and the intermediate connecting elements associated therewith.
Figure 29:
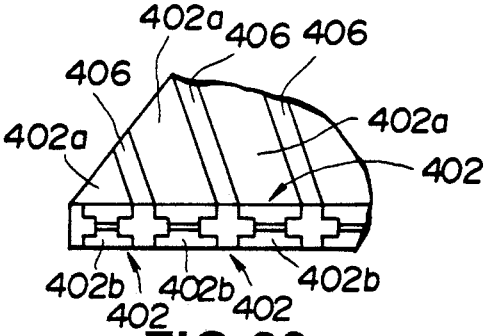
FIG. 29 is a fragmentary enlarged perspective view as viewed from the arrow XXIX in FIG. 25.

As shown in FIG. 28*a*, each of the laminate elements 402*a* and 402*b* of each of the wood veneers 402 has two sides, each of which is formed with a stepped cut-out. Each of the intermediate connecting elements 406 has a pair of fittings 406*a* and 406*b*, which are fitted respectively in the stepped cut-outs in the sides of the pair of laminate elements 402*a* and 402*b* of one of a corresponding pair of wood veneers 402 and in the stepped cut-outs in the sides of the pair of laminate elements 402*a* and 402*b* of the other of the corresponding pair of wood veneers 402. Each of the gaps 405 forms a corresponding one of a plurality of voids formed in the plate unit 401.

The intermediate connecting elements 406 have their respective tops and bottoms which are substantially flush with the front and rear sides respectively of the plate unit 401. Thus, the plate unit 401 has planar front and rear sides.

Provision of the gap 405 between the pair of laminate elements 402*a* and 402*b* of each of the wood veneers 402 enables the strength to be reduced with respect to the modulus of rigidity G in the area of the gap 405, so that the characteristic value corresponding to the modulus of rigidity G is reduced in the entire plate unit 401.

Figure 30:
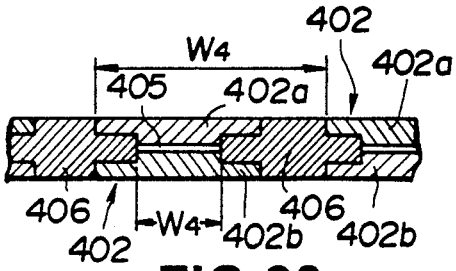
FIG. 30 is an enlarged cross-sectional view showing the width of the gap between the pair of laminate elements of each of the wood veneers in the fourth embodiment illustrated in FIGS. 25 through 27.

For instance, as shown in FIG. 30, let it be supposed that the distance from the left-hand sides of the respective laminate elements 402*a* and 402*b* to the right-hand sides of the respective laminate elements 402*a* and 402*b* is $W_4$, and the gap 405 therebetween has a width of $w_4$. Then, it is possible to increase the characteristic equivalent to the modulus of rigidity of the material $(W_4-w_4)/W_4$ times.

Figure 31:
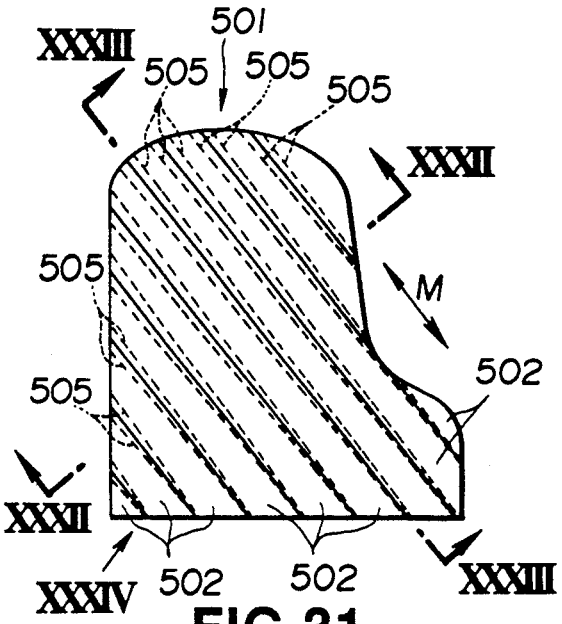
FIG. 31 is a top plan view of a sound board assembly according to the fifth embodiment of the invention.
Figure 32:
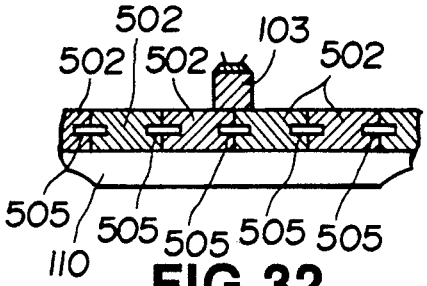
FIG. 32 is a fragmentary cross-sectional view taken along the line XXXII—XXXII in FIG. 31.
Figure 33:
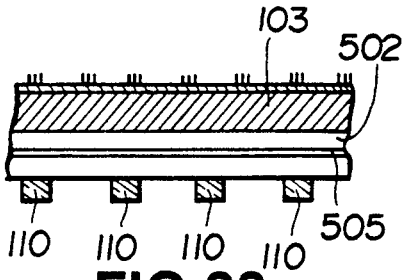
FIG. 33 is a fragmentary cross-sectional view taken along the line XXXIII—XXXIII in FIG. 31.
Figure 34:
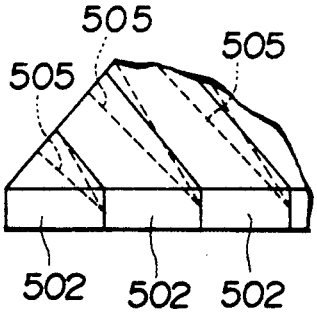
FIG. 34 is a fragmentary enlarged perspective view as viewed from the arrow XXXIV in FIG. 31.

Referring next to FIGS. 31 through 33, there is shown a sound board assembly according to the fifth embodiment of the invention. As shown in FIG. 31, the sound board assembly comprises a plurality of straight-grain wood veneers 502 which are joined together in a plane to form a plate unit 501 having front and rear sides.

A plurality of grooves 505 are formed in the plate unit 501 and extend in the direction M of the grain. Each of the grooves 505 is formed in at least one of the adjacent respective abutments of a corresponding pair of wood veneers 502. Each of the grooves 505 is formed at the center of a corresponding abutment of a corresponding one of the wood veneers 502. The grooves 505 have their respective widths in a direction perpendicular to the direction M of the grain, which widths vary in the direction M of the grain. Each of the grooves 505 is gradually enlarged in width from one end thereof to the other end thereof, that is, from one end of the plate unit 501 to the other end thereof.

As shown in FIG. 31, each of the grooves 505 has a width which is gradually enlarged in a linear fashion. In other words, each of the grooves 505 has a width which is gradually enlarged in a tapered fashion. Each pair of adjacent grooves 505 together form a corresponding one of a plurality of voids formed in the plate unit 501.

In the fifth embodiment illustrated in FIGS. 31 through 33, since the grooves 505 have their respective widths which gradually vary in the direction M of the grain, the value of E/G also varies successively. Accordingly, by the setting of the varying ratio of the groove widths, it is possible to optionally set the characteristic for the entire plate unit 501. That is, by the varying of the ratio of the groove widths, it is possible to set the optimum musical quality required for each compass. It is particularly, possible to considerably improve the musical quality in the low-pitched range.

Figure 35:
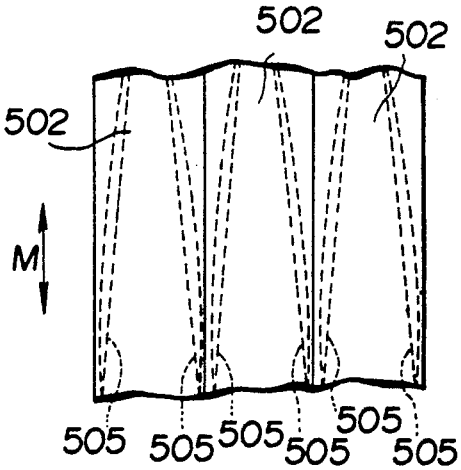
FIG. 35 is a fragmentary enlarged top plan view showing a plurality of wood veneers joined together, in the fifth embodiment illustrated in FIGS. 31 through 33.

FIG. 35 shows a modification of the fifth embodiment illustrated in FIGS. 31 through 33. In the above-described fifth embodiment, the groove widths vary in a linear manner. As shown in FIG. 35, however, the arrangement may be such that each of the grooves 505 has a width which varies in a curved fashion.

Further, the groove widths may not vary continuously, but may vary in a stepped manner. Moreover, the groove widths may vary only in a specific portion.

Figure 36:
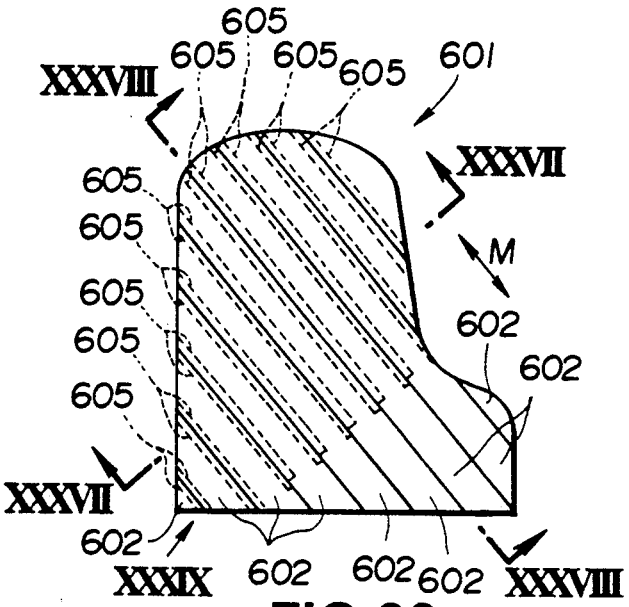
FIG. 36 is a top plan view of a sound board assembly according to the sixth embodiment of the invention.
Figure 37:
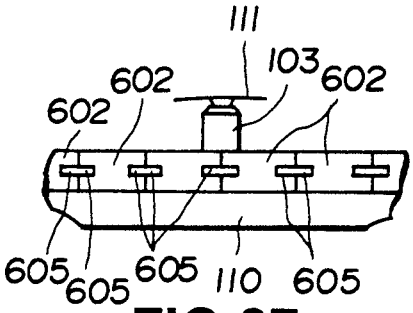
FIG. 37 is a fragmentary cross-sectional view taken along the line XXXVII—XXXVII in FIG. 36.
Figure 38:
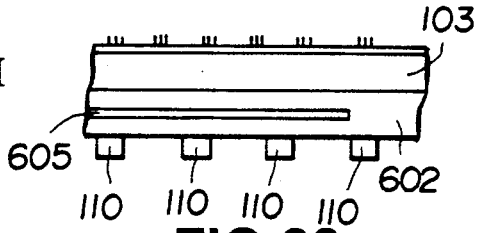
FIG. 38 is a fragmentary cross-sectional view taken along the line XXXVIII—XXXVIII in FIG. 36.

Referring next to FIGS. 36 through 38, there is shown a sound board assembly according to the sixth embodiment of the invention. As shown in FIG. 36, the sound board assembly comprises a plurality of straight-grain wood veneers 602 which are joined together in a plane to form a plate unit 601 having front and rear sides.

Figure 39:
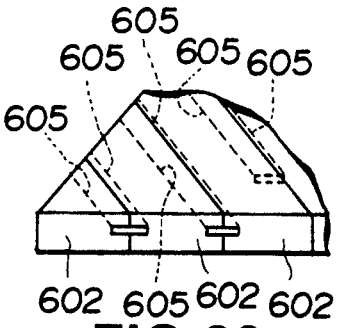
FIG. 39 is a fragmentary enlarged perspective view as viewed from the arrow XXXIX in FIG. 36.

Each of a plurality of grooves 605 is formed in a corresponding one of a pair of abutments of a corresponding one of the plurality of wood veneers 602, and extends in the direction M of the grain. As shown in FIG. 38, each of the grooves 605 is formed at the center of the corresponding abutment of a corresponding one of the wood veneers 602. As shown in FIGS. 36 and 39, each of the ends of the respective grooves 605 has a rectangular configuration in the plan.

The plate unit 601 has a first region of low-pitched sound and a second region of high-pitched sound. The plurality of strings 111 are supported by the treble bridge (long bridge) 103. Of the strings 111, the strings 111 within the first region are located in the upper portion in FIG. 36. Further, the bass bridge(short bridge) is provided on the right upper end portion in FIG. 36 (not shown). However, only the strings 111 within the low-pitched region are supported by the short bridge. That is, the portion of the plate unit 601 excluding the right lower portion thereof is the portion corresponding to the strings 111 within the low-pitched zone. The grooves 605 are arranged only at a location adjacent to the first region. That is, the grooves 605 are arranged only in the area of those strings 111 which are located in the first region.

As can be seen from FIG. 36 and 39, each of the grooves 605 have a respective end which is located at the boundary between the first and second regions. Specifically, each of the grooves 605 have a respective end which is located at the boundary of the low-pitched side of the strings 111 and the high-pitched side thereof.

Each of the grooves 605 is formed in a corresponding adjacent respective abutment of a corresponding pair of wood veneers 602, which are abutted against each other. Each pair of adjacent grooves 605 have respective openings which together form the corresponding one of a plurality of voids formed in the plate unit 601. In this connection, the ends of the respective grooves 605 are shifted away from each other, as shown in FIG. 36. This is because the forward ends of the respective grooves 605 are brought into agreement with the compass boundary of the strings 111.

The piano is a musical instrument which has extremely wide compasses, and the required quality of sound differs compass to compass. A gay or fine and growing or elongated sound are particularly sought the high-pitched zone, while a heavy and natural, non-metallic, sound is sought in the low-pitched zone. The tendencies in the sound quality of the piano are largely concerned with the driving point of the strings 111, that is, the construction and material of the sound board assembly in the vicinity of the position of the string support point in the bridge. Accordingly, in the case where, as is in the sixth embodiment, the grooves 605 are provided only in the portion corresponding to the strings 111 in the low-pitched zone, including a location in the vicinity of the low-pitched zone of the bridge, the aforesaid high-cut filter-like characteristics become remarkable with respect to the strings 111 at the low-pitched zone. Thus, the improvement in the quality of sound in this sound range is extremely effective. For this reason, it is possible to optimize the balance of the quality of sound between the compasses of the piano sound.

Figure 40:
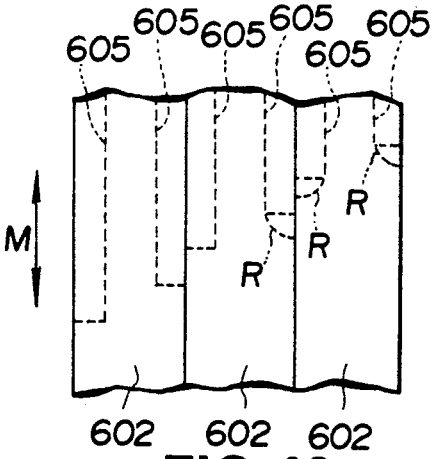
FIG. 40 is a fragmentary enlarged top plan view showing a plurality of wood veneers joined together, in the sixth embodiment illustrated in FIGS. 36 through 38.

FIG. 40 shows a modification of the sixth embodiment illustrated in FIGS. 36 through 38. In the above-described sixth embodiment, the grooves 605 have respective forward ends, each of which is formed into a rectangular configuration. As shown in FIG. 40, however, at least some of the ends of the respective grooves 605 may have a curved configuration in the plan. That is, each of the forward ends of the respective grooves 605 may have a predetermined radius of curvature R. This is preferable because, by doing so, the saw teeth can gradually be freed.

Referring next to FIGS. 41*a* through 46, there is shown a sound board assembly according to the seventh embodiment of the invention. As shown in FIGS. 42*a* and 42*b*, the sound board assembly comprises a plurality of straight-grain wood veneers 702 which are joined together in a plane to form a plate unit 701 having front and rear sides.

Figure 41A:
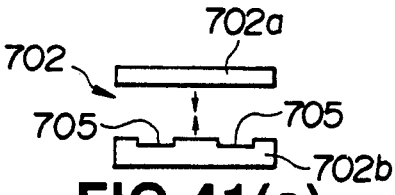
FIG. 41*a* is an enlarged exploded side elevational view showing the joining state of a pair of laminate elements of one of a plurality of straight-grain wood veneers which together form a sound board assembly according to the seventh embodiment of the invention.
Figure 41B:
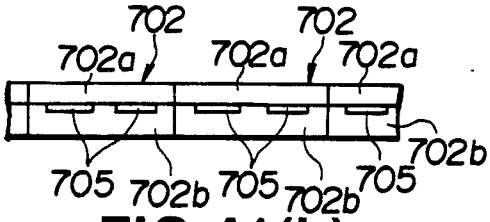
FIG. 41*b* is a side elevational view showing the joined state of the pairs of laminate elements and the pairs of adjacent wood veneers of the sound board assembly illustrated in FIG. 41*a;*
Figure 42A:
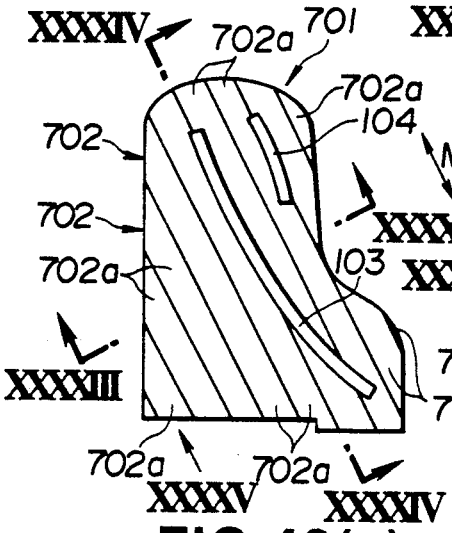
FIG. 42*a* is a top plan view of the sound board assembly according to the seventh embodiment of the invention.
Figure 42B:
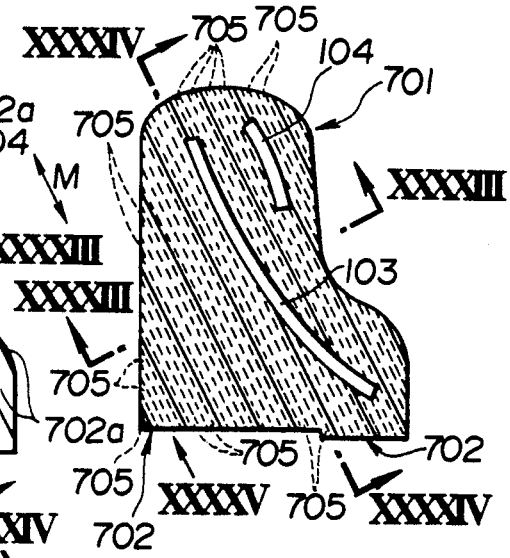
FIG. 42*b* is a view similar to FIG. 42*a*, but showing pairs of grooves, in broken lines, formed respectively in the wood veneers illustrated in FIGS. 41*a* and 41*b;*
Figure 43:
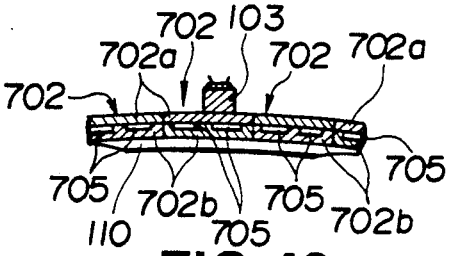
FIG. 43 is a fragmentary cross-sectional view taken along the line XXXXIII—XXXXIII in FIGS. 42*a* and 42*b;*
Figure 44:
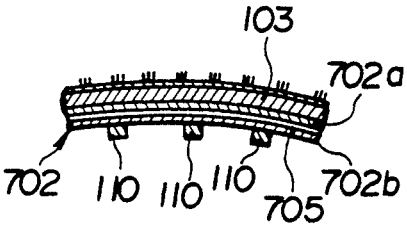
FIG. 44 is a fragmentary cross-sectional view taken along the line XXXXIV—XXXXIV in FIGS. 42*a* and 42*b;*
Figure 45:
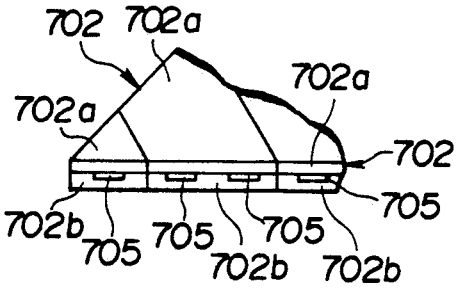
FIG. 45 is a fragmentary perspective view as viewed from the arrow XXXXV in FIGS. 42*a* and 42*b;*

As shown in FIGS. 41*b* and 43, each of the wood veneers 702 is composed of a pair of laminate elements 702*a* and 702*b* which are superimposed upon each other. The pair of laminate elements 702*a* and 702*b* of one of each pair of adjacent wood veneers 702 are abutted respectively against the pair of laminate elements 702*a* and 702*b* of the other wood veneer 702. In this manner, the wood veneers 702 are connected to and fixedly mounted to each other.

That is, the wood veneers 702 have respective pairs of cross-grain surfaces which serve respectively as the pairs of abutments of the respective wood veneers 702. Each of the wood veneers 702 has a straight-grain surface which is formed therein with two grooves 705 extending in the direction M of the grain.

Each of the grooves 705 formed respectively in the straight-grain surfaces of the respective pairs of laminate elements of wood veneers 702 forms a corresponding one of a plurality of voids formed in the plate unit 701. The straight-grain surface of one of each pair of laminate elements 702*b* of each of the wood veneers 702, in which the pair of grooves 705 and 705 are formed, serves as an abutment surface which is bonded to a straight-grain surface of the other laminate element 702*a*.

That is, the straight-grain surface of the one laminate element 702*b* is formed with two grooves 705 and 705 extending in the direction M of the grain in parallel relation to each other.

In the seventh embodiment, since the two laminate elements 702*a* and 702*b* of each of the wood veneers 702 are bonded to each other at their respective cross-grain surfaces, not so much thickness is required for each of the laminate elements 702*a* and 702*b*. Accordingly, it is possible to manufacture the sound board assembly using a relatively thin material.

Figure 46:
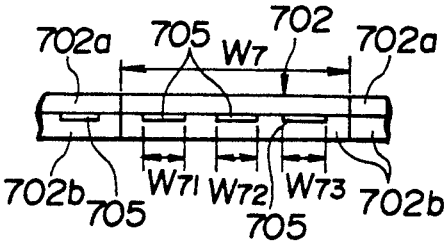
FIG. 46 is a fragmentary side elevational view showing the relationship between the width of the pair of laminate elements of each of a plurality of straight-grain wood veneers and the widths of the respective grooves formed in one of the pair of laminate elements according to a modification of the seventh embodiment illustrated in FIGS. 42*a* through 44.

In the seventh embodiment illustrated in FIGS. 41*a* through 45, the two grooves 705 and 705 are formed in the laminate element 702*b* of each of the pairs of laminate elements 702*a* and 702*b*. However, the number of the grooves 705 is optional. For example, as shown in FIG. 46, the straight-grain surface of the one laminate element 702*b* may be formed with three grooves 705 which extend in the direction M of the grain in parallel relation to each other. In this case, if it is assumed that the laminate elements 702*a* and 702*b* have respective widths $W_7$ and the three grooves 705, 705 and 705 have respective widths $w_{71}$, $w_{72}$ and $w_{73}$ from the left, it is possible to increase the characteristic of the material equivalent to the modulus of rigidity G $\{W_7-(w_{71}+w_{72}+w_{73})/W_7$ times. Further, if the number n of grooves is provided, it is possible to increase the characteristic of the material $(W_7-\Sigma W_n)$ times.

Figure 47:
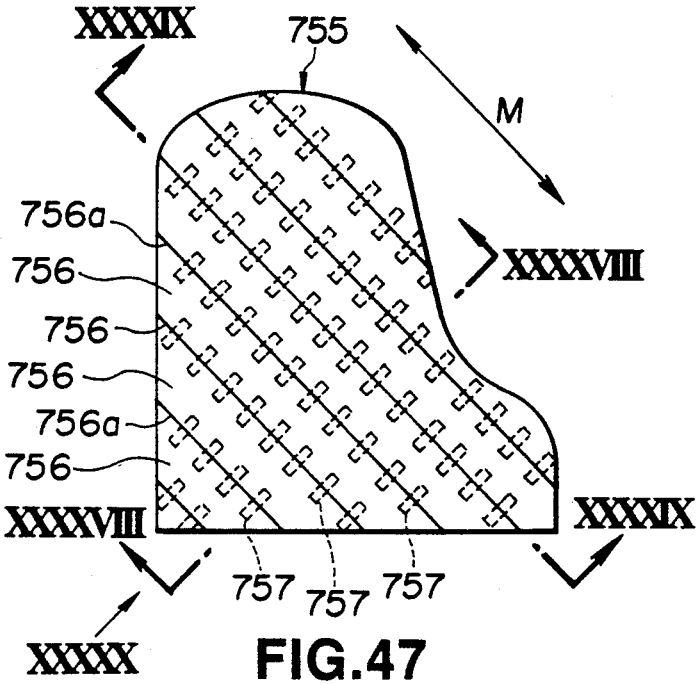
FIG. 47 is a top plan view of a sound board assembly according to the eighth embodiment of the invention.
Figure 48:
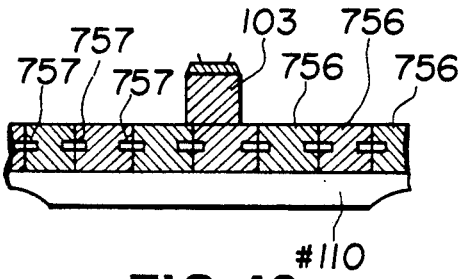
FIG. 48 is a fragmentary cross-sectional view taken along the line XXXXVIII—XXXXVIII in FIG. 47.
Figure 49:
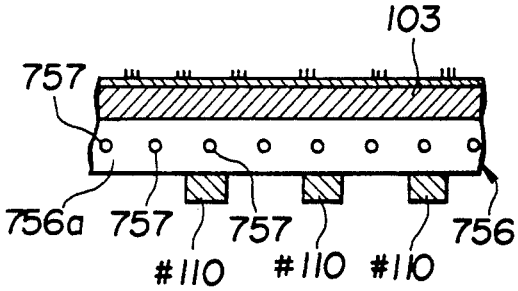
FIG. 49 is a fragmentary cross-sectional view taken along the line XXXXIX—XXXXIX in FIG. 47.
Figure 50:
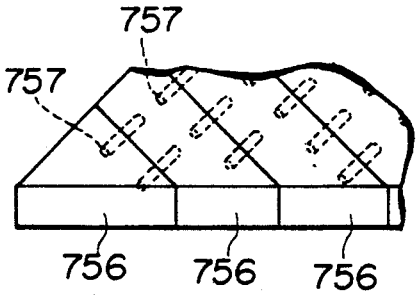
FIG. 50 is a fragmentary enlarged perspective view as viewed from the arrow XXXXX in FIG. 47.

Referring next to FIGS. 47 through 50, there is shown a sound board assembly according to the eighth embodiment of the invention. As shown in FIG. 47, the sound board assembly comprises a plurality of straight-grain wood veneers 756 which are joined together in a plane to form a plate unit 755 having front and rear sides.

A plurality of bores 757 are formed in adjacent respective abutments 756*a* of each pair of wood veneers 756. The bores 757 extend in a direction substantially perpendicular to the direction M of the grain. Each of the bores 757 is circular in cross-section. Specifically, the plural pairs of bores 757 and 757 are formed respectively in the adjacent respective abutments of each pair of wood veneers 756. The pairs of bores 757 extend in a direction substantially perpendicular to the direction M of the grain. Each pair of bores 757 and 757 are aligned with each other in a direction substantially perpendicular to the direction M of the grain as well as in the direction M of the grain.

Figure 51:
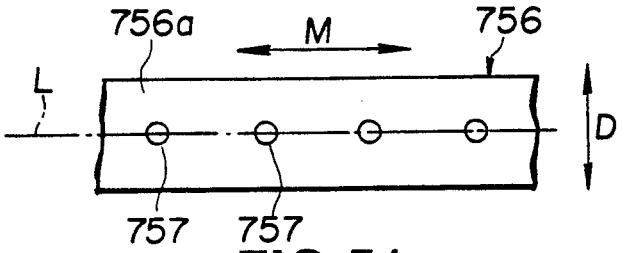
FIG. 51 is a fragmentary enlarged side elevational view for the explanation of the processing steps of the eighth embodiment illustrated in FIGS. 47 through 49.
Figure 52:
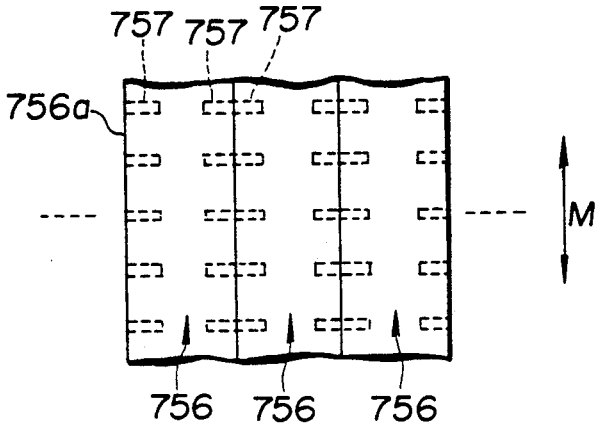
FIG. 52 is a fragmentary top plan view for the explanation of the processing steps illustrated in FIG. 51.

A method of processing the above-described bores 757 will be described with reference to FIGS. 51 and 52. First, before the wood veneers 756 are joined together, as shown in FIG. 51, each of the pair of abutments 756*a* and 756*a* of each of the wood veneers 756 is formed with the bores 757 along a center axis line L of the abutment 756*a* in a thickness direction D. The bores 757 are formed at constant pitches and have their respective constant diameters and depths. By doing this, the bores 757 and 757 are formed each of which extends in a direction substantially perpendicular to the direction M of the grain of the wood veneers 756. The wood veneers 756, having therein the bores 757 and 757 are joined together in a widthwise direction as shown in FIG. 52 and are bonded to each other, thereby forming the plate unit 755.

Figure 53:
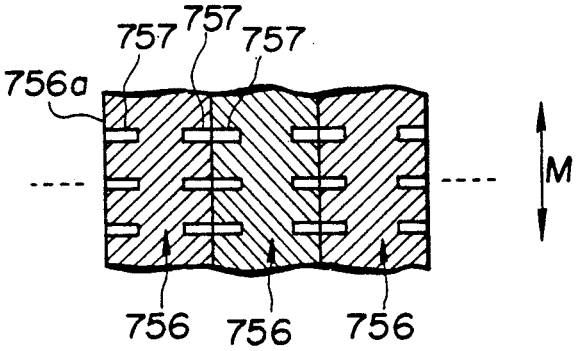
FIG. 53 is a fragmentary cross-sectional view of the eighth embodiment illustrated in FIGS. 47 through 49, taken along a center line of the sound board assembly in a thickness direction.

In the above arrangement, let it be assumed that the entire plate unit 755 has a plane projected area of S, and the portion of the plate unit 755 excluding the bore portions therein has a projected area or an effective area of S' as indicated by the oblique lines in FIG. 53. Then, by appropriately setting the diameter and depth of each of the bores 757 and the pitches there among or the number thereof, it is possible to set the strength of the material with respect to the shear deformation, that is, the characteristic of the material equivalent to the modulus of rigidity G by approximately $S'/S(<1)$ times. As a result, it is possible to raise to a desirable value, the value of the musical-quality associated material property E/G, which is the ratio between the modulus of longitudinal elasticity E and the modulus of rigidity G of the plate unit 755.

By forming the bores 757 in the wood veneers 756, there are obtained characteristics which are equal to or above the high-quality natural material generally used for the sound board assembly for the piano. Thus, it is possible to obtain a "sound", "warmth" and so on which is as a whole peculiar to a woody sound.

Figure 54:
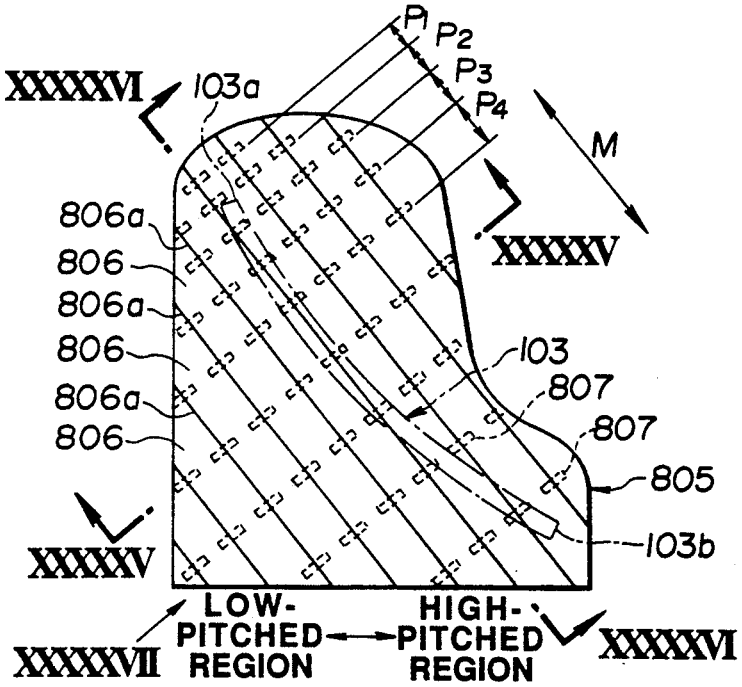
FIG. 54 is a top plan view of a sound board assembly according to the ninth embodiment of the invention.

Referring next to FIGS. 54 through 60, there is shown a sound board assembly according to the ninth embodiment of the invention. As shown in FIG. 54, the sound board assembly comprises a plurality of straight-grain wood veneers 806 which are joined together in a plane to form a plate unit 805 having front and rear sides.

Figure 56:
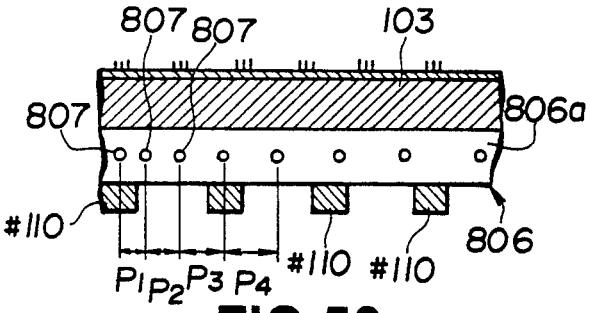
FIG. 56 is a fragmentary cross-sectional view taken along the line XXXXXVI—XXXXXVI in FIG. 54.
Figure 57:
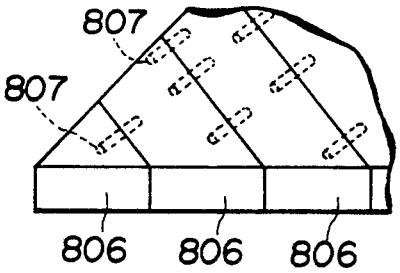
FIG. 57 is a fragmentary enlarged perspective view as viewed from the arrow XXXXXVII in FIG. 54.

A plurality of bores 807 are formed respectively in the adjacent respective abutments 806*a* of each pair of adjacent wood veneers 806. Each of the bores 807 is circular in cross-section. The bores 807 extend in a direction substantially perpendicular to the direction M of the grain and have respective diameters and depths. Each pair of bores 807 are aligned with each other in a direction substantially perpendicular to the direction of the grain, to form a corresponding one of a plurality of voids formed in the plate unit 805. The bores 807 are arranged at pitches $P_1$, $P_2$, $P_3$ and $P_4$ which vary along the direction M of the grain, as shown in FIG. 56.

The plate unit 805 has a first region of low-pitched sound and a second region of high-pitched sound. The above pitches $P_1$, $P_2$, $P_3$ and $P_4$ are gradually enlarged from the first region to the second region. That is, the pitches $P_1$, $P_2$, $P_3$ and $P_4$ gradually increase as the positions on the plate unit 805, by which the strings 111 are supported, approach the high-pitched region. The strings 111 are arranged so that the musical interval increases from one end 103*a* of the treble bridge 103 to the other end 103*b* thereof.

Figure 58:
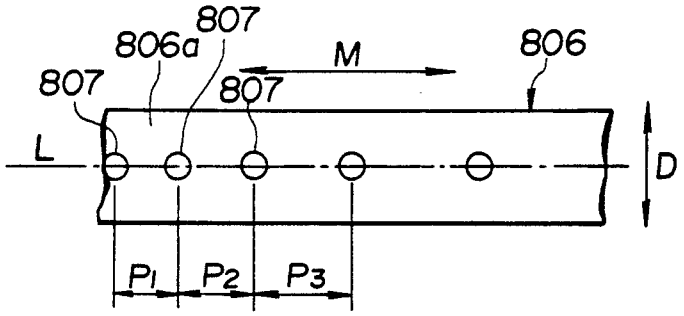
FIG. 58 is a fragmentary enlarged side elevational view for the explanation of the processing steps of the ninth embodiment illustrated in FIGS. 54 through 56.
Figure 59:
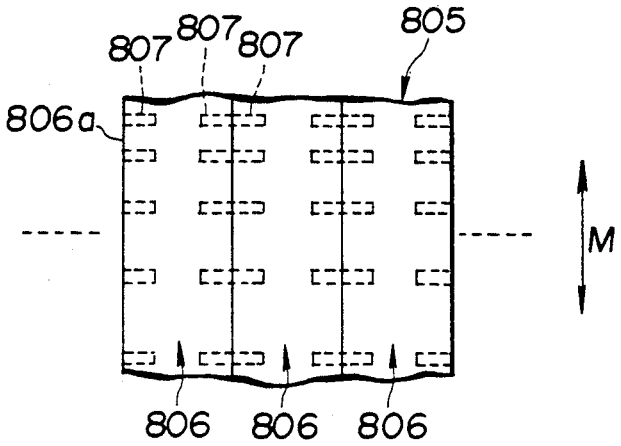
FIG. 59 is a fragmentary top plan view for the explanation of the processing steps illustrated in FIG. 58.

A method of processing the above-described bores 807 will be described with reference to FIGS. 58 and 59. First, before the wood veneers 806 are joined together, as shown in FIG. 58, each of the pair of abutments 806*a* and 806*b* of each of the wood veneers 806 is formed therein with the bores 807 along a center axis line L of the abutment 806*a* in a thickness direction D. Each of the bores 807 has a constant diameter and a constant depth. The bores 807 are formed at pitches $P_1$, $P_2$ and $P_3$ which are successively different from each other. By doing so, the bores 807 and 807 are formed each of which extends in a direction substantially perpendicular to the direction M of the grain of the wood veneers 806. The wood veneers 806, having therein the bores 807 and 807, are joined together in a widthwise direction as shown in FIG. 59, thereby forming the plate unit 805.

In the above arrangement, since the pitches $P_1$, $P_2$ and $P_3$ of the bores 807 vary in the direction M of the grain, it is possible to set the value of the musical-quality associated material property E/G to an adequate value in accordance with the generated compass of the plate unit 805. Specifically, the pitches $P_1$, $P_2$ and $P_3$ of the bores 807 increase gradually from the low-pitched region of the plate unit 805 driven by the one end 103*a* of the treble bridge 103 to the high-pitched region of the plate unit 805 driven by the other end 103*b* of the treble bridge 103, and the increasing degree or increment of the value of the musical-quality associated material property E/G is gradually reduced toward the high-pitched region. By doing so, it is possible to optimize the sound-quality balance between the compasses peculiar to the piano.

Figure 60:
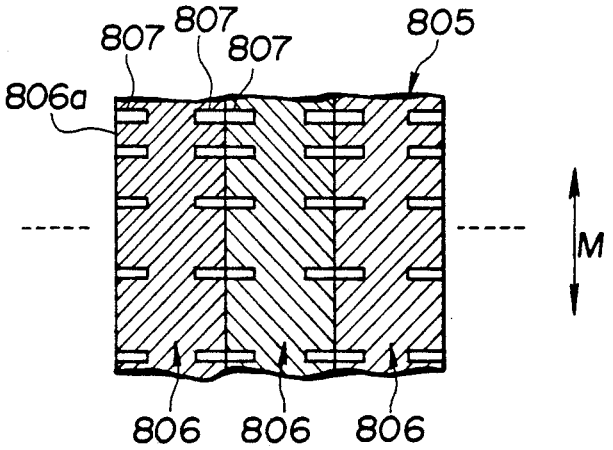
FIG. 60 is a fragmentary cross-sectional view of the ninth embodiment illustrated in FIGS. 54 through 56, taken along a center line of the sound board assembly in the direction of the thickness.

Similarly to the previous eighth embodiment described with reference to FIG. 53, it is possible in the ninth embodiment to raise, to a desirable value, the value of the musical-quality associated material property E/G, which is the ratio between the modulus of longitudinal elasticity E and the modulus of rigidity G of the plate unit 805, as will be seen from FIG. 60.

Figure 55:
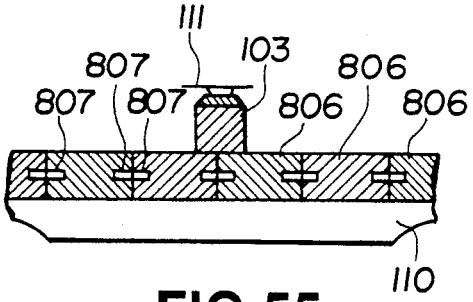
FIG. 55 is a fragmentary cross-sectional view taken along the line XXXXXV—XXXXXV in FIG. 54.
Figure 61:
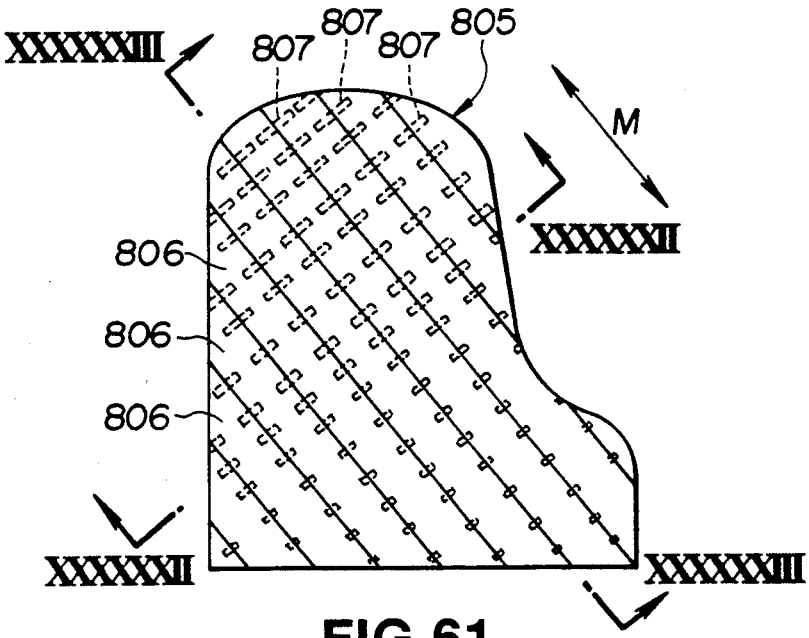
FIG. 61 is a top plan view of a sound board assembly according to a first modification of the ninth embodiment illustrated in FIGS. 54 through 56.
Figure 62:
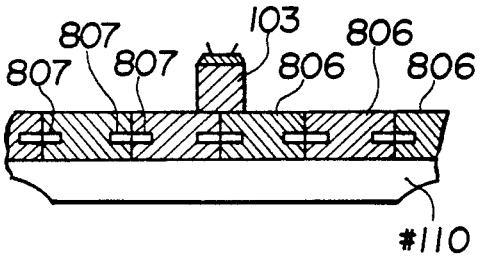
FIG. 62 is a fragmentary cross-sectional view taken along the line XXXXXXII—XXXXXXII in FIG. 61.
Figure 63:
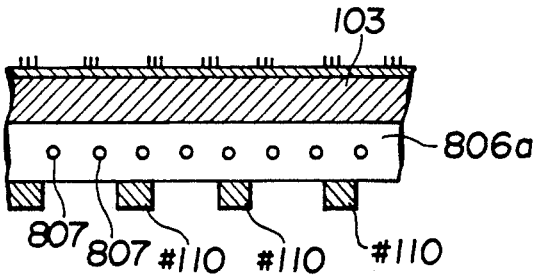
FIG. 63 is a fragmentary cross-sectional view taken along the line XXXXXXIII—XXXXXXIII in FIG. 61.

FIGS. 61 through 63 show a first modification of the ninth embodiment illustrated in FIGS. 54 through 56. In the first modification, the diameters of the respective bores 807 and the pitches $P_1$, $P_2$ and $P_3$ of the bores 807 are constant, and only the depths of the respective bores 807 vary in the direction M of the grain. The depths of the respective bores 807 are gradually reduced toward the above-described second region. That is, the depths of the respective bores 807 vary as the string support portion on the plate unit 805 approaches the high-pitched side.

Figure 64:
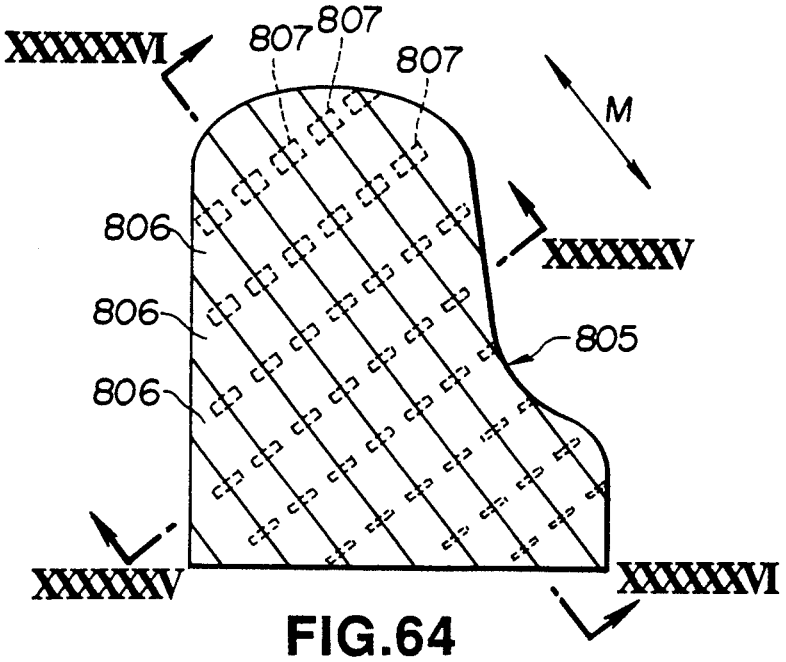
FIG. 64 is a top plan view of a sound board assembly according to a second modification of the ninth embodiment illustrated in FIGS. 54 through 56.
Figure 65:
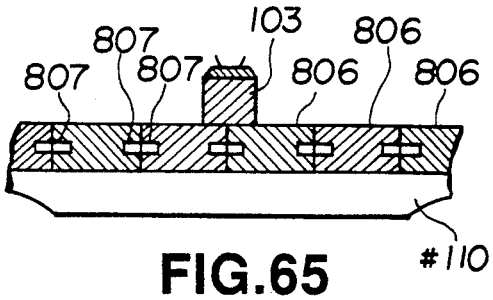
FIG. 65 is a fragmentary cross-sectional view taken along the line XXXXXXV—XXXXXXV in FIG. 64.
Figure 66:
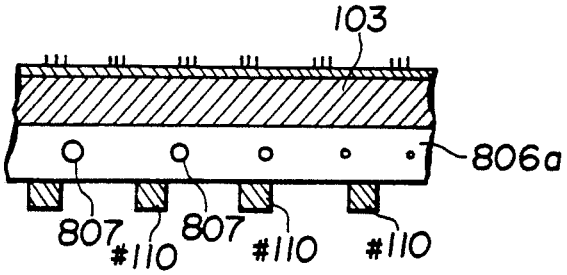
FIG. 66 is a fragmentary cross-sectional view taken along the line XXXXXXVI—XXXXXXVI in FIG. 64.

FIGS. 64 through 66 show a second modification of the ninth embodiment illustrated in FIGS. 54 through 56. In the second modification, the depths of the respective bores 807 and the pitches among the bores 807 are constant, and only the diameters of the respective bores 807 vary in the direction M of the grain. The diameters of the respective bores 807 are gradually reduced toward the above-mentioned second region. That is, the diameters of the respective bores 807 are gradually reduced as the string support positions on the plate unit 805 approach the high-pitched side.

In the above first and second modifications, the depths or diameters of the respective bores 807 are gradually reduced toward the high-pitched region of the plate unit 805 from the low-pitched region thereof. By doing so, the increasing degree or increment of the musical-quality associated material property E/G is gradually reduced toward the high-pitched region. Thus, an attempt can be made to optimize the sound-quality balance between the compasses peculiar to the piano.

In the manner described above, according to the ninth embodiment and the first and second modifications thereof, at least one of the diameters and depths of the bores 807 and the pitches there among or number thereof varies in the direction M of the grain. Thus, it is possible to optionally set the strength of the material with respect to the shear deformation, that is, the character of the material equivalent to the modulus of rigidity G, in accordance with the generated compasses (corresponding area of the sound board driven by certain string) of the plate unit 805. By doing so, it is possible to set the value of the musical-quality associated material property of each portion of the plate unit 805 artificially and freely.

Figure 67:
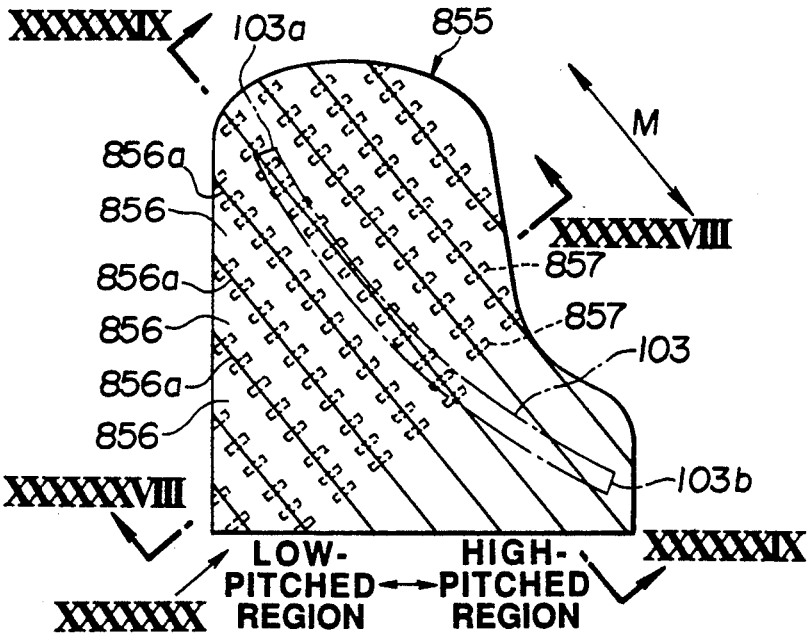
FIG. 67 is a top plan view of a sound board assembly according to the tenth embodiment of the invention.
Figure 68:
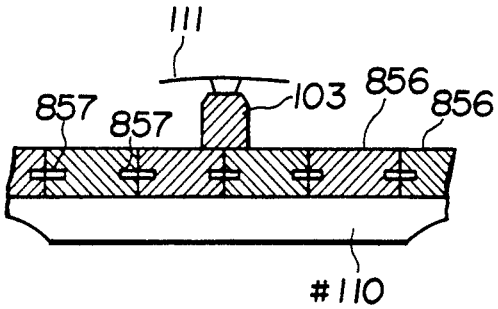
FIG. 68 is a fragmentary cross-sectional view taken along the line XXXXXXVIII—XXXXXXVIII in FIG. 67.
Figure 69:
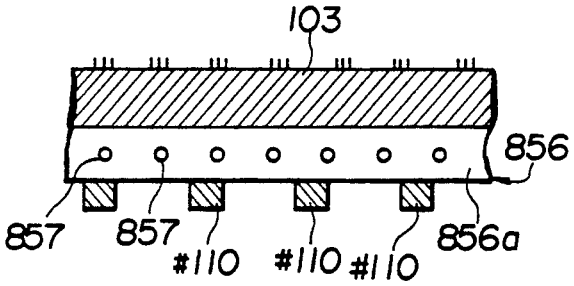
FIG. 69 is a fragmentary cross-sectional view taken along the line XXXXXXIX—XXXXXXIX in FIG. 67.
Figure 70:
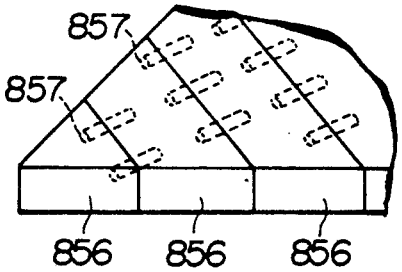
FIG. 70 is a fragmentary enlarged perspective view as viewed from the arrow XXXXXXX in FIG. 67.

Referring next to FIGS. 67 through 73, there is shown a sound board assembly according to the tenth embodiment of the invention. As shown in FIG. 67, the sound board assembly comprises a plurality of straight-grain wood veneers 856 which are joined together in a plane to form a plate unit 855 having front and rear sides.

A plurality of bores 857 are formed respectively in adjacent respective abutments 856*a* and 856*a* of each pair of wood veneers 856. The bores 857, arranged in a row, extend in a direction substantially perpendicular to the direction M of the grain. Each of the bores 857 is circular in cross-section. In this case, the bores 857 are formed only in a specific section or portion of the plate unit 855, that is, only in a string support section on the low-pitched side to which vibration or oscillation of the strings 111 in the low-pitched region is transmitted through the long bridge 103. That is, the plate unit 855 has a first region of low-pitched sound and a second region of high-pitched sound. The bores 857 are arranged only at a location adjacent to the first region. The strings 111 are arranged such that the musical interval gradually increases from the one end 103*a* of the long bridge 103 to the other end 103*b* thereof.

Figure 71:
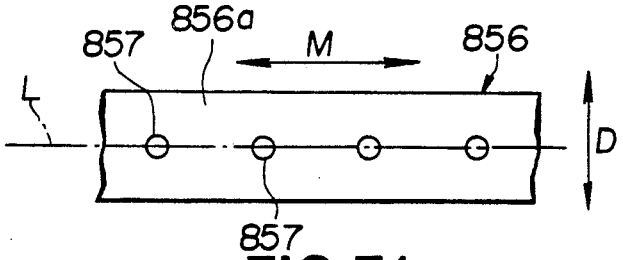
FIG. 71 is a fragmentary side elevational view for the explanation of the processing steps of the tenth embodiment illustrated in FIGS. 67 through 69.
Figure 72:
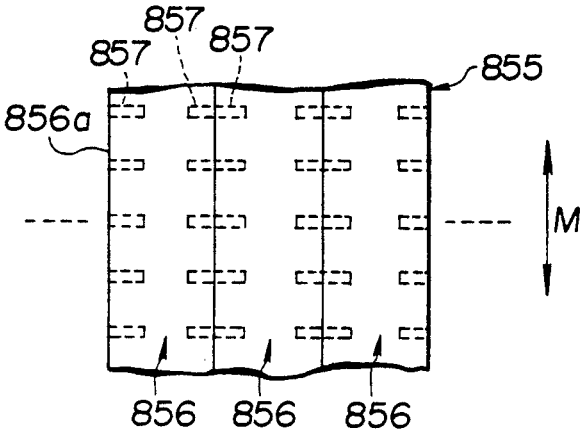
FIG. 72 is a fragmentary top plan view for explanation of the processing steps illustrated in FIG. 71.

A method of processing the above-described bores 857 will be described with reference to FIGS. 71 and 72. First, before the wood veneers 856 are joined together, as shown in FIG. 71, each of the pair of abutments 856*a* and 856*a* of each of the wood veneers 856 is formed therein with the bores 857 along a center axis line L of the abutment 856*a* in a thickness direction D. Each of the bores 857 has a constant diameter and a constant depth. The bores 857 are formed only at the specific portion or location. By doing so, the bores 857 and 857 are formed, each of which extends in a direction substantially perpendicular to the direction M of the grain of the wood veneers 856. The wood veneers 856 having therein the bores 857 and 857 are joined together in a widthwise direction as shown in FIG. 72, thereby forming the plate unit 855.

Figure 73:
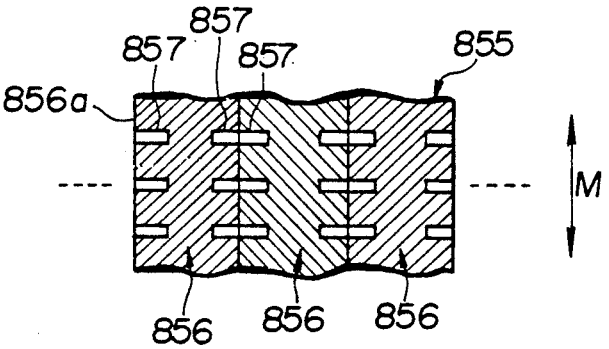
FIG. 73 is a fragmentary cross-sectional view of the tenth embodiment illustrated in FIGS. 67 through 69, taken along a center line of the sound board assembly in the direction of the thickness.

Similarly to the previous eighth embodiment described with reference to FIG. 53, it is possible in the tenth embodiment to raise, to a desirable value, the value of the musical-quality associated material property E/G, which is the ratio between the modulus of longitudinal elasticity E and the modulus of rigidity G of the plate unit 805, as will be seen from FIG. 73.

In the above-described arrangement, the bores 857 are formed only in the specific section or portion of the plate unit 855, that is, only in the string support section on the low-pitched side to which vibration or oscillation of the strings 111 in the low-pitched region is transmitted through the treble bridge 103. Accordingly, it is possible to set the value of the musical-quality associated material property E/G to an optimum value in accordance with the generated compasses of the plate unit 855, and it is also possible to set the sound-quality balance between the generated compasses to an optimum state. That is, the bores 857, arranged in a row, are formed in the string support section on the low-pitched side of the plate unit 855 which is driven through a location in the vicinity of the one end 103*a* of the treble bridge 103, to raise the value of the musical-quality associated material property E/G. By doing so, it is possible to optimize the sound-quality balance between the compasses peculiar to the piano.

Figure 74:
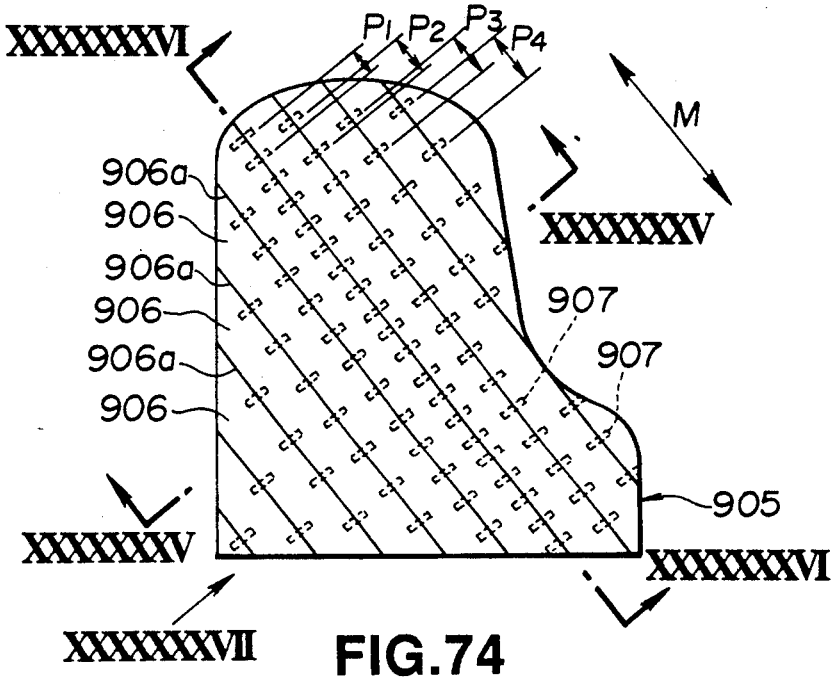
FIG. 74 is a top plan view of a sound board assembly according to the eleventh embodiment of the invention.

Referring next to FIGS. 74 through 80, there is shown a sound board assembly according to the eleventh embodiment of the invention. As shown in FIG. 74, the sound board assembly comprises a plurality of straight-grain wood veneers 906 which are joined together in a plane to form a plate unit 905 having front and rear sides.

A plurality of bores 907 are formed in adjacent respective abutments 906*a* and 906*a* of each pair of a plurality of wood veneers 906. The bores 907 extend in a direction substantially perpendicular to the direction M of the grain and have respective diameters and depths. Each of the bores 907 is circular in cross-section. The bores 907 are arranged at their respective pitches $P_1$, $P_2$, $P_3$ and $P_4$. The pitches $P_1$, $P_2$, $P_3$ and $P_4$ of the bores 907 formed in the pair of abutments 906*a* of each pair of adjacent wood veneer 906 are different from those among the bores 907 formed in the pair of abutments 906*a* of the other wood veneer 906. That is, the pitches $P_1$, $P_2$, $P_3$ and $P_4$ among the bores 907 formed in the pairs of abutments 906*a* of the respective wood veneers 906 are gradually enlarged from the central region of the plate unit 905 to the peripheral region thereof.

Figure 79:
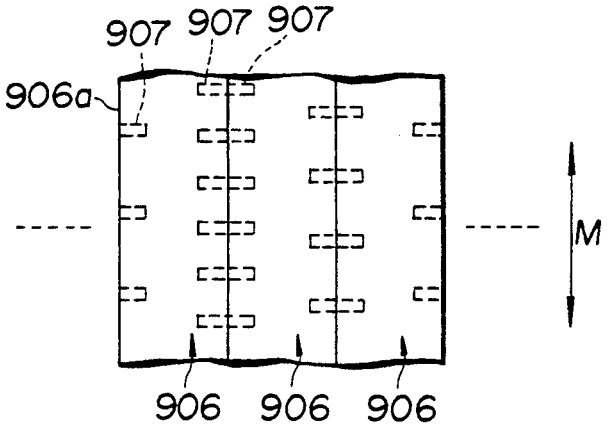
FIG. 79 is a fragmentary top plan view for the explanation of the processing steps illustrated in FIG. 78.

As described above, the bores 907 have respective constant diameters and depths. In this case, the pitches $P_1$, $P_2$, $P_3$ and $P_4$ among the bores 907 vary in each of the wood veneers 907. By doing so, the bores 907 and 907 are formed, each of which extends in a direction substantially perpendicular to the direction M of the grain of the wood veneers 906. The wood veneers 906, having therein the bores 907 and 907, are joined together in a widthwise direction and are bonded to each other as shown in FIG. 79, thereby forming the plate unit 905.

Figure 80:
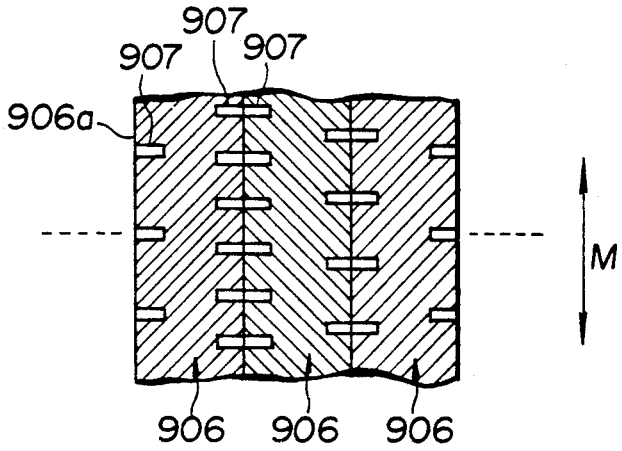
FIG. 80 is a fragmentary cross-sectional view of the eleventh embodiment illustrated in FIGS. 74 through 76, taken along a center line of the sound board assembly in the direction of the thicknes.

Similarly to the previous eighth embodiment described with reference to FIG. 53, it is possible in the eleventh embodiment to raise, to a desirable value, the value of the musical-quality associated material property E/G, which is the ratio between the modulus of longitudinal elasticity E and the modulus of rigidity G of the plate unit 905, as will be seen from FIG. 80.

In the above-described arrangement, since the pitches of the bores 907 are different in each of the wood veneers 906, the value of the musical-quality associated material property E/G is set to an optimum value in accordance with the generated compasses of the plate unit 905, whereby it is possible to set the sound-quality balance between the generated compasses to an optimum state.

Figure 87:
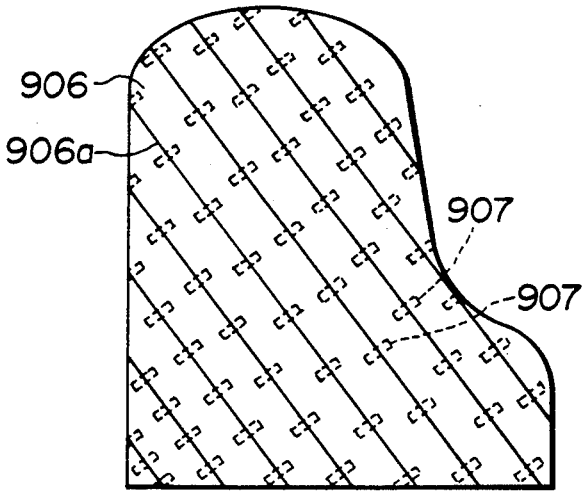
FIG. 87 is a top plan view of a sound board assembly according to a first modification of the eleventh embodiment illustrated in FIGS. 74 through 76.

In the above eleventh embodiment, the pitches $P_1$, $P_2$, $P_3$ and $P_4$ of the bores 907 are gradually enlarged toward the peripheral region of the plate unit 905. As shown in a first modification illustrated in FIG. 87, however, the pitches among the bores 907 may be gradually reduced toward the peripheral region of the plate unit 905. By doing so, there is obtained individuality in other qualities of sound.

Figure 75:
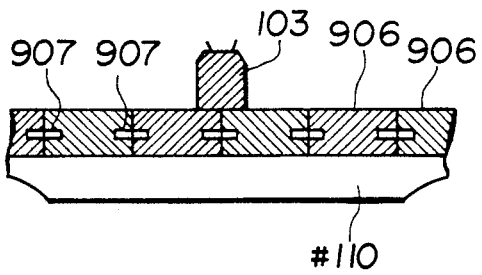
FIG. 75 is a fragmentary cross-sectional view taken along the line XXXXXXXV—XXXXXXXV in FIG. 74.
Figure 76:
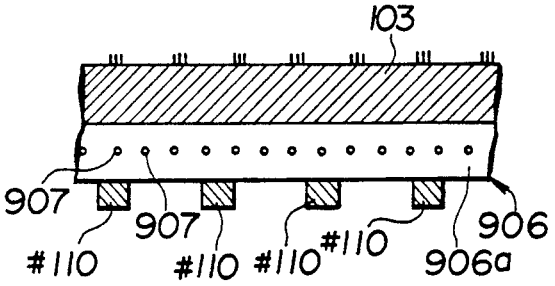
FIG. 76 is a fragmentary cross-sectional view taken along the line XXXXXXXVI—XXXXXXXVI in FIG. 74.
Figure 77:
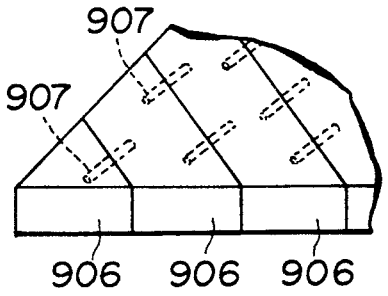
FIG. 77 is a fragmentary enlarged perspective view as viewed from the arrow XXXXXXXVII in FIG. 74.
Figure 78:
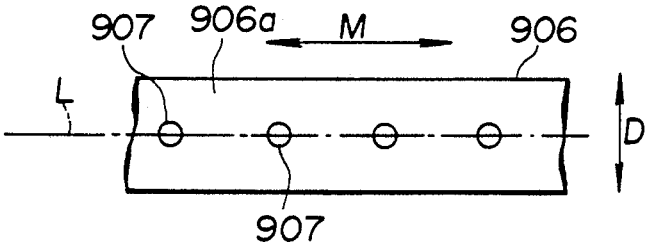
FIG. 78 is a fragmentary side elevational view for the explanation of the processing steps of the eleventh embodiment illustrated in FIGS. 74 through 76.
Figure 81:
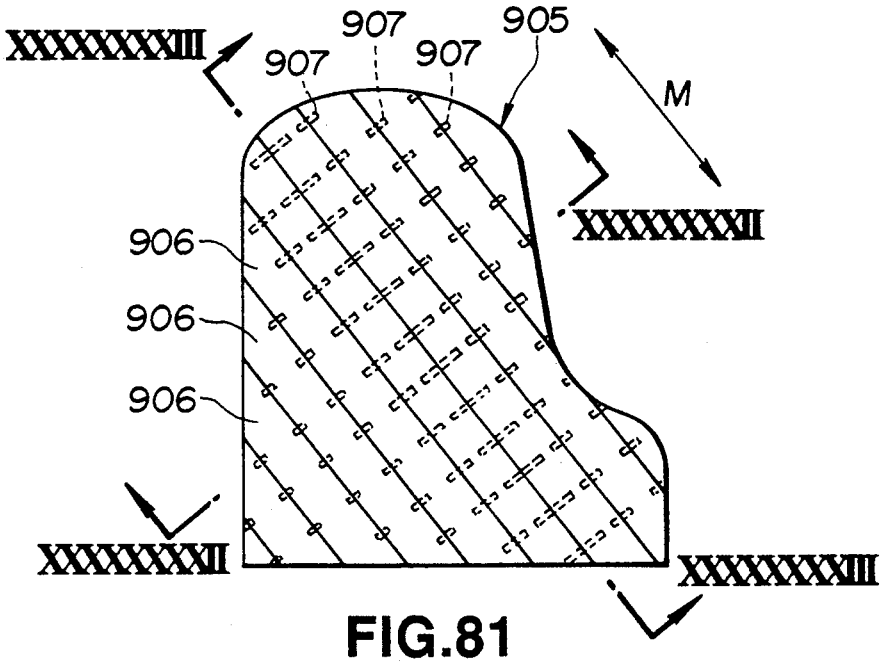
FIG. 81 is a top plan view of a sound board assembly according to a second modification of the eleventh embodiment illustrated in FIGS. 74 through 76.
Figure 82:
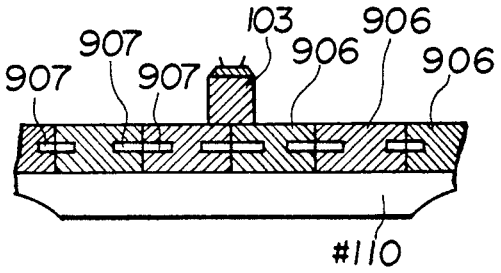
FIG. 82 is a fragmentary cross-sectional view taken along the line XXXXXXXXII—XXXXXXXXII in FIG. 81.
Figure 83:
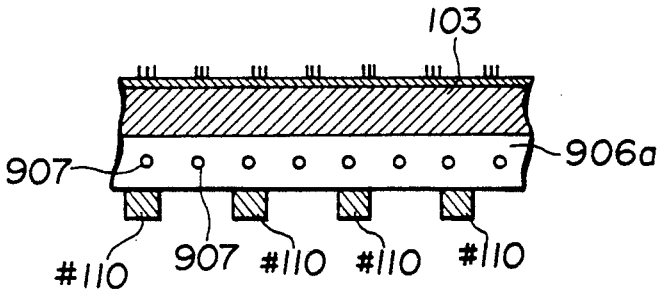
FIG. 83 is a fragmentary cross-sectional view taken along the line XXXXXXXXIII—XXXXXXXXIII in FIG. 81.
Figure 88:
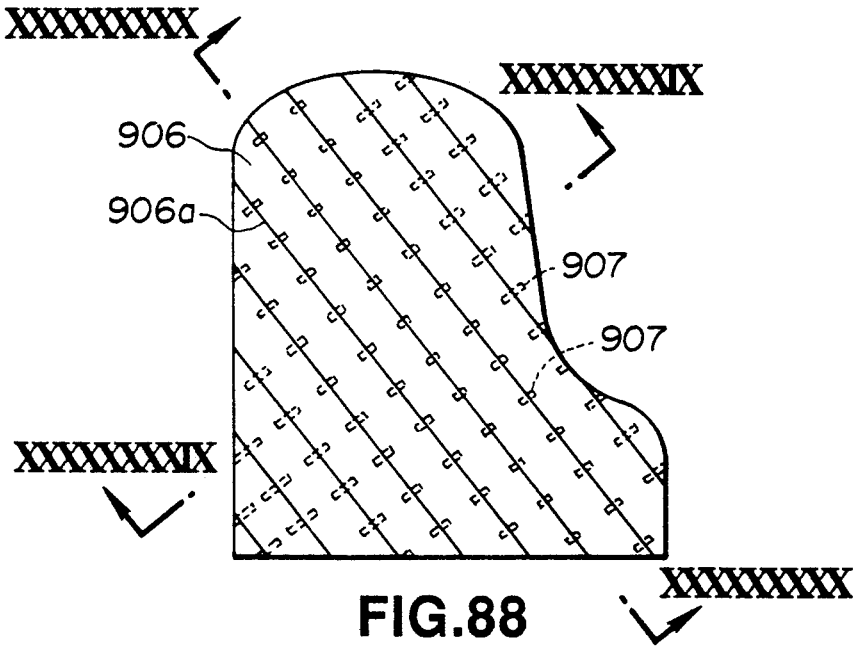
FIG. 88 is a top plan view of a sound board assembly according to a third modification of the eleventh embodiment illustrated in FIGS. 74 through 76.
Figure 89:
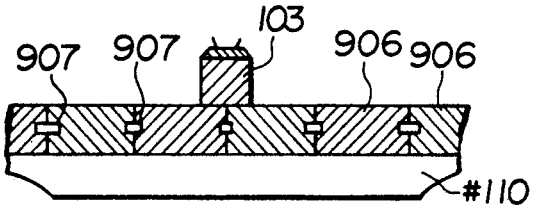
FIG. 89 is a fragmentary cross-sectional view taken along the line XXXXXXXXIX—XXXXXXXXIX in FIG. 88.
Figure 90:
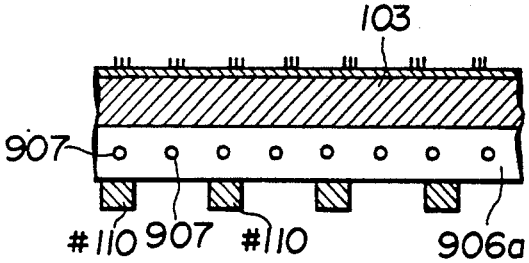
FIG. 90 is a fragmentary cross-sectional view taken along the line XXXXXXXXX—XXXXXXXXX in FIG. 88.

FIGS. 81 through 83 show a second modification of the eleventh embodiment illustrated in FIGS. 74 through 76. In the second modification, the pitches among the bores 907 are constant, and the diameters of the respective bores 907 are constant. However, only the depths of the respective bores 907 formed in one of the pair of abutments 906*a* of each of the wood veneers 906 are different from those of the respective bores 907 formed in the other abutment 906*a* of the wood veneer 906. The depths of the respective bores 907 are gradually reduced from the central region of the plate unit 905 toward the peripheral region thereof. That is, the depths of the respective bores 907 are gradually enlarged from the peripheral region of the plate unit 905 toward the central region thereof. In this connection, as shown in a third modification illustrated in FIGS. 88 through 90, if the depths of the respective bores 907 are gradually enlarged toward the peripheral region of the plate unit 905, it is possible to realize a musical quality which has another type of individuality.

Figure 84:
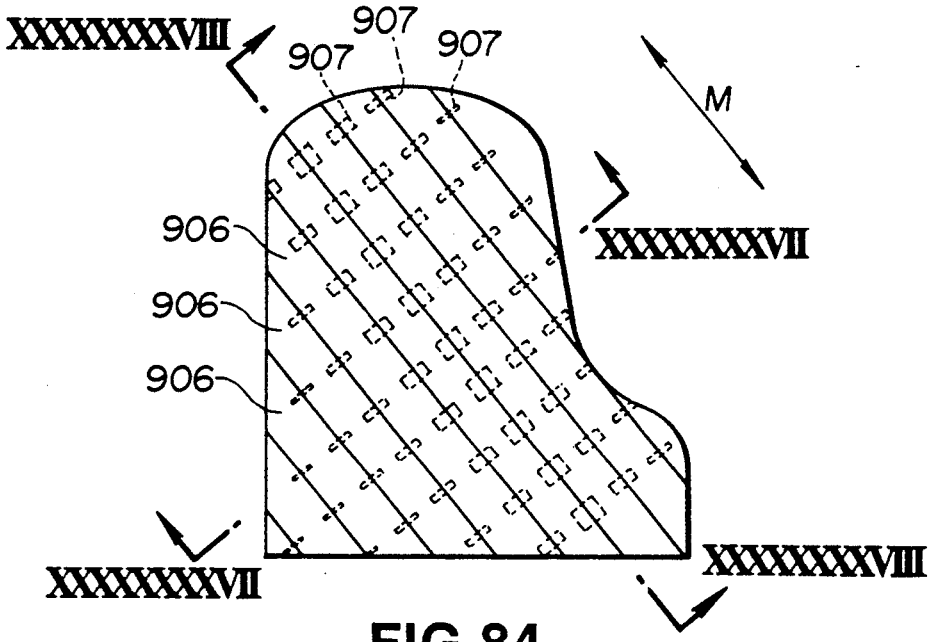
FIG. 84 is a top plan view of a sound board assembly according to a fourth modification of the eleventh embodiment illustrated in FIGS. 74 through 76.
Figure 85:
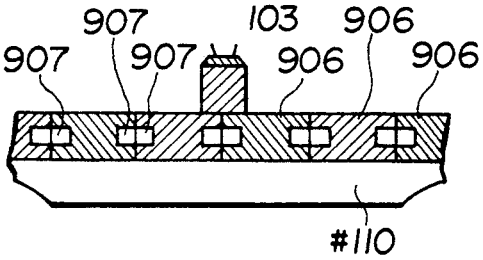
FIG. 85 is a fragmentary cross-sectional view taken along the line XXXXXXXXV—XXXXXXXXV in FIG. 84.
Figure 86:
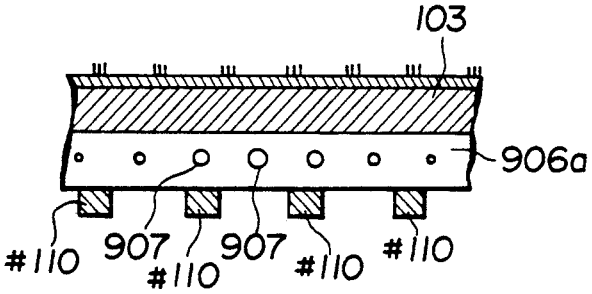
FIG. 86 is a fragmentary cross-sectional view taken along the line XXXXXXXXVI—XXXXXXXXVI in FIG. 84.
Figure 91:
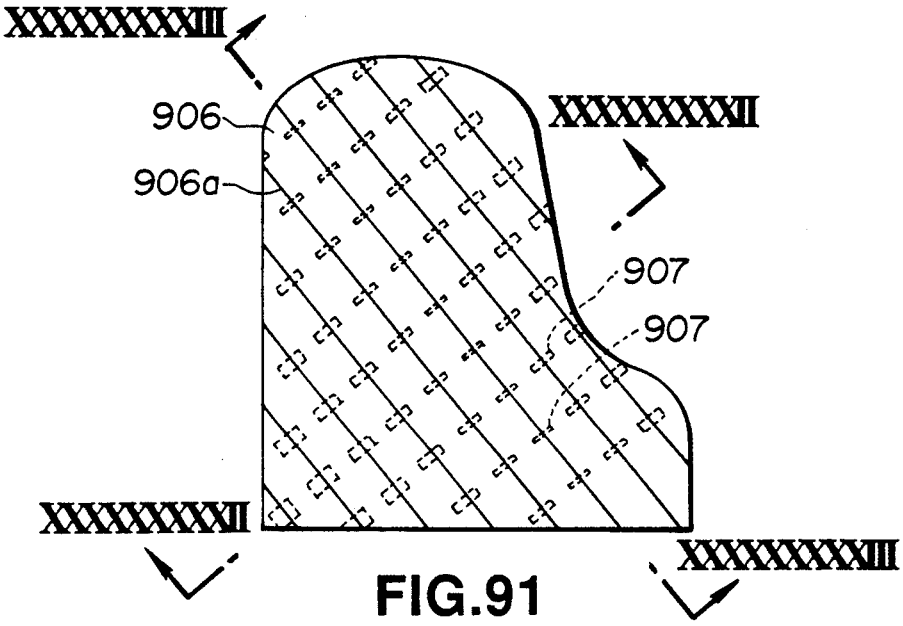
FIG. 91 is a top plan view of a sound board assembly according to a fifth modification of the eleventh embodiment illustrated in FIGS. 74 through 76.
Figure 92:
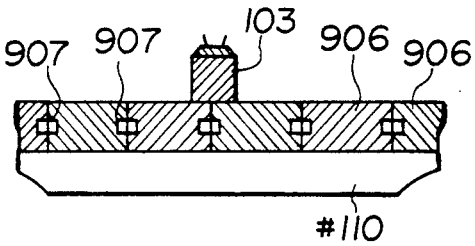
FIG. 92 is a fragmentary cross-sectional view taken along the line XXXXXXXXXII—XXXXXXXXXII in FIG. 91.
Figure 93:
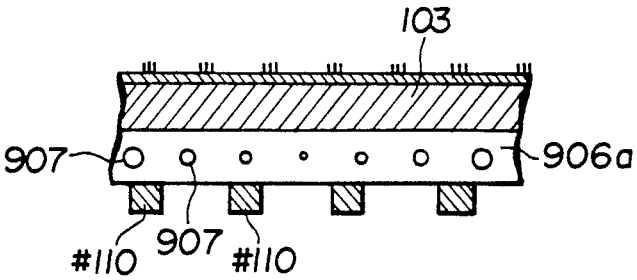
FIG. 93 is a fragmentary cross-sectional view taken along the line XXXXXXXXXIII—XXXXXXXXXIII in FIG. 91.
Figure 94:
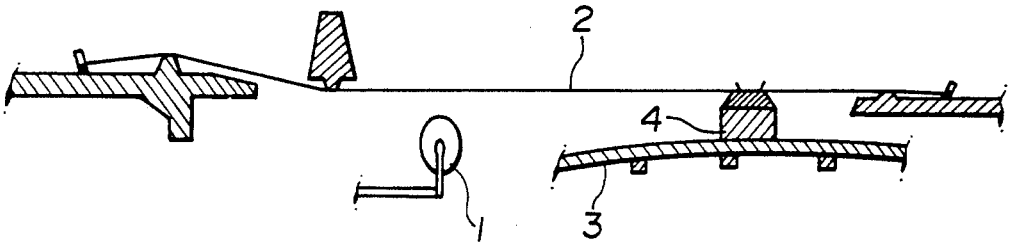
FIG.94 (PRIOR ART)
FIG. 94 is a schematic constitutional view showing a note hitting mechanism of a conventional grand piano.

FIGS. 84 through 86 show a fourth modification of the eleventh embodiment illustrated in FIGS. 74 through 76. In the fourth modification, the depths of the respective bores 907 and the pitches among the bores 907 are constant, and only the diameters of the respective bores 907 formed in one of the pair of abutments 906*a* of each of the wood veneers 906 are different from those of the respective bores 907 formed in the other abutment 906*a* of the wood veneer 906. The diameters of the respective bores 907 are gradually reduced from the central region of the plate unit 905 toward the peripheral region thereof. That is, the diameters of the respective bores 907 are gradually enlarged from the peripheral region of the plate unit 905 toward the central region thereof. In this connection, as shown in a fifth modification illustrated in FIGS. 91 through 93, if the diameters of the respective bores 907 are gradually enlarged toward the peripheral region of the plate unit 905, it is possible to realize a musical quality which has another type of individuality.

In these second and fourth modifications of the eleventh embodiment, the depths or diameters of the respective bores 907 are gradually reduced toward the peripheral region of the plate unit 905 from the central region thereof, whereby the increasing degree or increment of the value of the musical-quality associated material property E/G is gradually reduced, so that the individuality of the sound-quality balance between the compasses peculiar to the piano can be set.

What is claimed is:

1. A sound board assembly for a musical instrument, comprising:

a plurality of straight grain wood veneers joined together in a first plane to form a plate unit having at least first and second surfaces, each of the wood veneers extending in a direction along the grain of the wood veneer and arranged in parallel relation to each other, and a plurality of voids formed in the plate unit, wherein the plate unit includes a low-pitched region and a high-pitched region, wherein the plurality of voids are arranged within the low-pitched region, the high-pitched region being substantially free of voids.

2. A sound board assembly according to claim 1, further including at least one bridge provided on one of the first and second surfaces of the plate unit and extending in a direction substantially along the grain of the wood veneer, and a plurality of ribs provided on the other of the first and second surfaces of the plate unit and extending in a direction substantially perpendicular to the grain of the wood veneer in spaced relation to with respect to each other.

3. A sound board assembly according to claim 1, wherein the plurality of voids are formed along a second plane formed substantially midway between the first and second surfaces of the plate unit.

4. A sound board assembly according to claim 1, wherein the plurality of voids are formed between the wood veneers of the plate unit.

5. A sound board assembly according to claim 1, wherein each of the plurality of wood veneers have lateral sides serving respectively as abutments, wherein each of the plurality of wood veneers have at least one lateral side abutted against and joined to a lateral side of an adjacent wood veneer.

6. A sound board assembly according to claim 1, wherein the plurality of voids are formed by a plurality of bores extending in a direction substantially perpendicular to the grain direction of the wood veneer.

7. A sound board assembly according to claim 1, wherein the plurality of voids have long axes which are substantially perpendicular to the grain direction of the wood veneer, the plurality of voids being aligned with each other in the grain direction of the wood veneer.

8. A sound board assembly according to claim 1, wherein the plurality of voids are formed such that the first and second surfaces of the plate unit are free of voids.

9. A sound board assembly according to claim 1, wherein the plurality of voids are formed so as to be spaced from the first and second surfaces of the plate unit.

10. A sound board assembly according to claim 1, wherein the plurality of voids are formed in a string support section within the low-pitched region.

11. A sound board assembly according to claim 1, wherein the plurality of voids are comprises of a plurality of bores respectively formed in adjacent wood veneers, the plurality of bores being arranged in a row which extends along a direction of the wood grain.

12. A sound board assembly according to claim 11, wherein each of the plurality of bores are respectively formed such that bores in adjacent veneers are opposingly arranged so as to form voids extending between adjacent veneers.

13. A sound board assembly according to claim 12, wherein each of the plurality of bores are formed substantially perpendicular with respect to a direction of the grain of the wood veneers.

14. A sound board assembly for a musical instrument, comprising:

a plurality of straight grain wood veneers joined together in a first plane to form a plate unit having at least first and second surfaces, each of the wood veneers extending in a direction along the grain of the wood veneer and arranged in parallel relation to each other, and a plurality of voids formed in the plate unit, wherein the plurality of voids are selectively arranged in the plate unit in accordance with a property E/G, where E represents the modulus of longitudinal elasticity and G represents a modulus of rigidity.

15. A sound board assembly according to claim 14, wherein the plate unit includes a low-pitched region and a high-pitched region, wherein the plurality of voids are selectively arranged within the low-pitched region so as to increase a value of the material property E/G.

16. A sound board assembly according to claim 15, wherein the plurality of voids are formed in a string support section within the low-pitched region.

17. A sound board assembly for a musical instrument, comprising:

a plurality of straight grain wood veneers joined together in a first plane to form a plate unit having at least first and second surfaces, each of the wood veneers extending in a direction along the grain of the wood veneer and arranged in parallel relation to each other, and a plurality of voids formed at respective locations between the plurality wood veneers in the plate unit, the plurality of voids being formed along a second plane, wherein the plurality of voids are arranged in a configuration that varies in the direction of the grain.

18. A sound board assembly according to claim 17, wherein the plurality of voids are arranged in accordance with a predetermined configuration depending on a location within the plate unit.

19. A sound board assembly according to claim 17, wherein the plurality of voids are comprises of a plurality of bores respectively formed in adjacent wood veneers, the plurality of bores being arranged in a row which extends along a direction of the grain of the wood veneers.

20. A sound board assembly according to claim 19, wherein each of the plurality of bores are respectively formed such that bores in adjacent veneers are opposingly arranged so as to form voids extending between adjacent veneers.

21. A sound board assembly according to claim 20, wherein each of the plurality of bores are formed substantially perpendicular with respect to a direction of the grain of the wood veneers.

22. A sound board assembly for a musical instrument, comprising:

a plurality of straight grain wood veneers joined together in a first plane to form a plate unit having at least first and second surfaces, each of the wood veneers extending in a direction along the grain of the wood veneers and arranged in parallel relation to each other, and a plurality of voids formed at respective locations between the plurality wood veneers in the plate unit, the plurality of voids being formed along a second plane, further including at least one bridge provided on one of the first and second surfaces of the plate unit and extending in a direction along the grain direction, and a plurality of ribs provided on the other of the first and second surfaces extending in a direction perpendicular to the grain direction in spaced relation with respect to each other, wherein the plurality of voids are distributed in accordance with a location of the at least one bridge.

23. A sound board assembly according to claim 22, wherein the plate unit includes a low pitch side and a high pitch side which are decided by sides of the bridge, wherein the plurality of voids are arranged decreasingly from the low pitched side to the high pitched side.

24. A sound board assembly according to claim 22, wherein the plate unit includes a low pitch side and a high pitch side which are decided by sides of the bridge, wherein the plurality of voids are arranged within the low pitched side, the high pitched side being substantially free of voids.

25. A sound board assembly according to claim 24, wherein the plurality of voids are formed in a string support section within the low pitched side.

26. A sound board assembly for a musical instrument, comprising:

a plurality of straight grain wood veneers joined together in a first plane to form a plate unit having at least first and second surfaces, each of the wood veneers extending in a direction along the grain of the wood veneer and arranged in parallel relation to each other, and a plurality of voids formed at respective locations between the plurality wood veneers in the plate unit, the plurality of voids being formed along a second plane, wherein the plate unit includes a low-pitched region and a high-pitched region, wherein the plurality of voids are arranged within the low-pitched region, the high-pitched region being substantially free of voids.

27. A sound board assembly according to claim 24, wherein the plurality of voids are formed in a string support section within the low-pitched region.

28. A sound board assembly for a musical instrument, comprising:

a plurality of straight grain wood veneers joined together in a first plane to form a plate unit having at least first and second surfaces, each of the wood veneers extending in a direction along the grain of the wood veneer and arranged in parallel relation to each other, and a plurality of voids formed at respective locations between the plurality wood veneers in the plate unit, the plurality of voids being formed along a second plane, wherein the plurality of voids are selectively arranged in the plate unit in accordance with a property E/G, where E represents the modulus of longitudinal elasticity and G represents a modulus of rigidity.

29. A sound board assembly according to claim 28, wherein the plate unit includes a low-pitched region and a high-pitched region, wherein the plurality of voids are selectively arranged within the low-pitched region so as to increase a value of the material property E/G.

30. A sound board assembly according to claim 29, wherein the plurality of voids are formed in a string support section within the low-pitched side.

* * * * *